US011613336B2

(12) United States Patent
Mizutani

(10) Patent No.: US 11,613,336 B2
(45) Date of Patent: Mar. 28, 2023

(54) OUTBOARD MOTOR AND OUTBOARD MOTOR MOVEMENT MECHANISM

(71) Applicant: YAMAHA HATSUDOKI KABUSHIKI KAISHA, Iwata (JP)

(72) Inventor: Makoto Mizutani, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 180 days.

(21) Appl. No.: 17/164,862

(22) Filed: Feb. 2, 2021

(65) Prior Publication Data

US 2021/0179244 A1 Jun. 17, 2021

Related U.S. Application Data

(62) Division of application No. 16/597,869, filed on Oct. 10, 2019, now Pat. No. 11,338,895.

(30) Foreign Application Priority Data

Oct. 25, 2018 (JP) ..... JP2018-201090

(51) Int. Cl.
*B63H 20/10* (2006.01)
*B63H 20/02* (2006.01)

(52) U.S. Cl.
CPC ..... *B63H 20/10* (2013.01); *B63H 20/02* (2013.01)

(58) Field of Classification Search
CPC ..... B63H 20/10; B63H 20/02; B63H 20/06
USPC ..... 440/61 t
See application file for complete search history.

(56) References Cited

U.S. PATENT DOCUMENTS

| | | | | |
|---|---|---|---|---|
| 2,966,876 A | 1/1961 | MacWilliam | | |
| 4,654,914 A * | 4/1987 | Leeper | A43D 23/02 | 12/12.5 |
| 2003/0157848 A1 * | 8/2003 | Saito | B63H 20/10 | 440/61 T |

OTHER PUBLICATIONS

Mizutani, "Outboard Motor and Outboard Motor Movement Mechanism", U.S. Appl. No. 16/597,869, filed Oct. 10, 2019.
Mizutani, "Outboard Motor and Outboard Motor Movement Mechanism", U.S. Appl. No. 17/164,863, filed Feb. 2, 2021.
Official Communication issued in corresponding European Patent Application No. 19204254.7, dated Oct. 6, 2022.

* cited by examiner

*Primary Examiner* — Anthony D Wiest
(74) *Attorney, Agent, or Firm* — Keating and Bennett, LLP

(57) ABSTRACT

An outboard motor includes an outboard motor main body, a support including a tilt shaft and that supports the outboard motor main body, and a trim cylinder including a first trim cylinder shaft disposed below the tilt shaft along an outer surface of a transom of a hull. A distance between the tilt shaft and the first trim cylinder shaft is adjustable.

8 Claims, 13 Drawing Sheets

FIRST PREFERRED EMBODIMENT (SECOND TO SIXTH PREFERRED EMBODIMENTS)

FIRST PREFERRED EMBODIMENT

FIRST PREFERRED EMBODIMENT

FIRST PREFERRED EMBODIMENT

SECOND PREFERRED EMBODIMENT

SIXTH PREFERRED EMBODIMENT

FIRST MODIFIED EXAMPLE

SECOND MODIFIED EXAMPLE

THIRD MODIFIED EXAMPLE

FOURTH MODIFIED EXAMPLE

OUTBOARD MOTOR AND OUTBOARD MOTOR MOVEMENT MECHANISM

CROSS REFERENCE TO RELATED APPLICATIONS

This application claims the benefit of priority to Japanese Patent Application No. 2018-201090 filed on Oct. 25, 2018. The entire contents of this application are hereby incorporated herein by reference.

BACKGROUND OF THE INVENTION

1. Field of the Invention

The present invention relates to an outboard motor and an outboard motor movement mechanism.

2. Description of the Related Art

An outboard motor is known in general. Such an outboard motor is disclosed in U.S. Pat. No. 4,786,263, for example.

U.S. Pat. No. 4,786,263 discloses an outboard motor including an outboard motor main body and an outboard motor movement mechanism including a support including a tilt shaft and that supports the outboard motor main body, and a trim cylinder including a trim cylinder shaft. In the outboard motor, the tilt shaft and the trim cylinder are disposed at predetermined positions, and the trim and tilt operating ranges are set in fixed angular ranges.

However, in the outboard motor disclosed in U.S. Pat. No. 4,786,263, the tilt shaft and the trim cylinder are disposed at the predetermined positions, and the trim and tilt operating ranges are set in the fixed angular ranges, and thus the trim and tilt operating ranges cannot be flexibly changed according to the type of marine vessel.

SUMMARY OF THE INVENTION

Preferred embodiments of the present invention provide outboard motors and outboard motor movement mechanisms that flexibly change the trim and tilt operating ranges according to the type of marine vessel.

An outboard motor according to a preferred embodiment of the present invention includes an outboard motor main body, a support including a tilt shaft and that supports the outboard motor main body, and a trim cylinder including a first trim cylinder shaft disposed below the tilt shaft along an outer surface of a transom of a hull. A distance between the tilt shaft and the first trim cylinder shaft is adjustable.

In an outboard motor according to a preferred embodiment of the present invention, the distance between the tilt shaft and the first trim cylinder shaft is adjustable such that when the distance between the tilt shaft and the first trim cylinder shaft is increased, both the upper and lower limits of the trim and tilt operating ranges are lowered, and when the distance between the tilt shaft and the first trim cylinder shaft is decreased, both the upper and lower limits of the trim and tilt operating ranges are raised. That is, the trim and tilt operating ranges are flexibly changed according to the type of marine vessel. The term "trim and tilt operating ranges" does not indicate the angular range of the outboard motor main body restricted (defined) by a limiting device (limiting mechanism) that restricts rotation of the outboard motor main body, but indicates the angular range of the outboard motor main body defined by the attachment positions (arrangements) of the first trim cylinder shaft and the tilt shaft in a state in which the limiting device (limiting mechanism) does not restrict rotation of the outboard motor main body, and the angular range of the outboard motor main body between the upper limit and the lower limit of the inclination angle of the outboard motor main body about the tilt shaft.

An outboard motor according to a preferred embodiment of the present invention preferably further includes a mount attached to the outer surface of the transom and that rotatably supports each of the tilt shaft and the first trim cylinder shaft. Accordingly, the attachment position of each of the tilt shaft and the first trim cylinder shaft with respect to the transom is easily changed by the mount, and thus the trim and tilt operating ranges are more flexibly changed according to the type of marine vessel.

In such a case, the mount preferably includes a first support that rotatably supports the tilt shaft, and a second support provided separately from the first support and that rotatably supports the first trim cylinder shaft, and the distance between the tilt shaft and the first trim cylinder shaft is preferably adjusted by changing a relative position between the first support and the second support in an upward-downward direction. Accordingly, the tilt shaft and the first trim cylinder shaft are attached to the transom independently of each other by the first support and the second support which are different from each other, and thus the attachment position of each of the tilt shaft and the first trim cylinder shaft with respect to the transom is more easily changed. Consequently, the trim and the tilt operating ranges are more flexibly changed according to the type of marine vessel.

An outboard motor including the mount preferably further includes a position adjuster provided in the mount and that changes a position of at least one of the tilt shaft and the first trim cylinder shaft in the upward-downward direction with respect to the transom by changing a position of at least one of the first support and the second support in the upward-downward direction. Accordingly, the position of at least one of the tilt shaft and the first trim cylinder shaft in the upward-downward direction with respect to the transom is easily changed by the position adjuster.

In an outboard motor including the position adjuster in the mount, the mount preferably further includes a base plate attached to the transom and on which the first support and the second support are installed such that the first support and the second support are independently repositionable relative to each other in the upward-downward direction. Accordingly, the base plate is attached to the transom such that the first support and the second support are indirectly attached to the transom, and thus the attachment positions of the first support and the second support with respect to the base plate are changed. Therefore, even before the first support and the second support are attached to the hull, the attachment position of each of the tilt shaft and the first trim cylinder shaft with respect to the transom is changed (adjusted). That is, the trim and tilt operating ranges are easily changed.

In an outboard motor including the position adjuster in the mount, the position adjuster preferably includes a hole that extends in the upward-downward direction or a plurality of holes aligned in the upward-downward direction, the hole or the plurality of holes being provided in at least one of the first support and the second support, and a fastener inserted into a predetermined upward or downward position of the hole that extends in the upward-downward direction or inserted into one of the plurality of holes, and that fixes at least one of the first support and the second support to the transom so as to maintain the position of at least one of the tilt shaft and the first trim cylinder shaft in the upward-downward direction with respect to the transom. Accordingly, the first support and the second support are easily attached and removed by using the fastener. Furthermore, attachment of the first support and the second support to one of the plurality of holes or the hole that extends in the upward-downward direction is reliably held by the fastener.

In an outboard motor in which the mount includes the base plate, the position adjuster preferably includes a plurality of mounting holes aligned in the upward-downward direction in the base plate, and a fastener inserted into one of the plurality of mounting holes and that fixes at least one of the first support and the second support to the base plate so as to maintain the position of at least one of the tilt shaft and the first trim cylinder shaft in the upward-downward direction with respect to the transom. Accordingly, even before the first support and the second support are attached to the hull, the attachment position of each of the tilt shaft and the first trim cylinder shaft with respect to the transom is changed (adjusted) by using the fastener. Thus, the trim and tilt operating ranges are more easily changed.

In an outboard motor including the position adjuster in the mount, the position adjuster preferably includes a spacer mount provided in the second support and in which the first support is movable in the upward-downward direction, and a spacer disposed above or below the first support in the spacer mount in contact with the first support and the second support and that maintains the position of the tilt shaft in the upward-downward direction with respect to the transom. Accordingly, the attachment position of the first support is securely held by the spacer mount and the spacer, and the trim and tilt operating ranges are easily changed.

In an outboard motor including the position adjuster in the mount, the first support preferably includes a fixed portion fixed to the transom, and a link including a front end supported by the fixed portion and a rear end that rotatably supports the tilt shaft of the support, and the position adjuster preferably includes a rotation restricting shaft inserted into the fixed portion and the link, the rotation restricting shaft maintaining an angle of the link at a predetermined angle by restricting rotation of the link with respect to the fixed portion and also changing the predetermined angle. Accordingly, the rotation restricting shaft restricts rotation of the link with respect to the fixed portion by maintaining the angle of the link at the predetermined angle, but is also able to change the predetermined angle such that the position of the tilt shaft supported by the rear end of the link with respect to the first trim cylinder shaft is changed by the rotation restricting shaft. Therefore, a structure that changes (adjusts) the distance between the tilt shaft and the first trim cylinder shaft is achieved by the fixed portion, the link, and the rotation restricting shaft.

In an outboard motor including the position adjuster in the mount, the position adjuster preferably includes a guide rail that guides movement of the first support in the upward-downward direction. Accordingly, the first support is reliably disposed on the path of the guide rail, and thus the guide rail prevents deviation of the attachment position of the first support.

In such a case, the position adjuster preferably further includes an upward-downward drive cylinder that moves the first support in the upward-downward direction along the guide rail. Accordingly, the first support is easily moved along the guide rail by the upward-downward drive cylinder.

In an outboard motor in which the mount includes the first support and the second support, the first support preferably includes a pair of first supports provided side by side in a right-left direction so as to rotatably support the tilt shaft, and the second support preferably includes a pair of second supports provided side by side in the right-left direction so as to rotatably support the first trim cylinder shaft. Accordingly, the tilt shaft and the first trim cylinder shaft are more securely supported by the first support and the second support as compared with the case in which only the longitudinal centers of the tilt shaft and the first trim cylinder shaft are supported.

In an outboard motor in which the mount includes the first support and the second support, the trim cylinder preferably includes a second trim cylinder shaft disposed at a rear end of the trim cylinder, and the outboard motor main body preferably includes pivot shafts integral and unitary with the outboard motor main body, the pivot shafts being supported at a rear end of the support and the second trim cylinder shaft so as to be rotatable in a right-left direction. Accordingly, the number of components is reduced as compared with the case in which the pivot shafts are separate from the outboard motor main body, and thus the device structure is simplified. Furthermore, the outboard motor main body is more securely steered as compared with the case in which the pivot shafts are separate from the outboard motor main body.

In such a case, the trim cylinder and the support preferably respectively support the pivot shafts, and the second trim cylinder shaft is preferably located below the first trim cylinder shaft when the trim cylinder is in a most contracted state. Accordingly, as compared with the case in which the second trim cylinder shaft is located above the first trim cylinder shaft when the trim cylinder is in the most contracted state, the trim cylinder supports the pivot shaft at a position farther away from the tilt shaft (fulcrum). Thus, the outboard motor main body is trimmed and tilted with less power.

In an outboard motor according to a preferred embodiment of the present invention, the trim cylinder preferably includes a second trim cylinder shaft disposed at a rear end of the trim cylinder, and the support preferably includes a first portion that extends rearward from the tilt shaft and a second portion that extends downward from a rear end of the first portion, is L-shaped or substantially L-shaped (hereinafter "L-shaped") and defined by the first portion and the second portion, and is rotatably supported by the second trim cylinder shaft. Accordingly, the second portion of the L-shaped support is disposed along the outboard motor main body, and thus the support securely supports the outboard motor main body.

In such a case, the second trim cylinder shaft is preferably disposed in a vicinity of or adjacent to a connection location between the first portion and the second portion, and is preferably disposed above the first trim cylinder shaft. Accordingly, a load that acts on the connection location (L-shaped corner) between the first portion and the second portion is reduced as compared with the case in which the second trim cylinder shaft is disposed in the vicinity of or adjacent to the second portion away from the first portion.

An outboard motor movement mechanism according to a preferred embodiment of the present invention includes a support including a tilt shaft and that supports an outboard motor main body, and a trim cylinder including a trim cylinder shaft disposed below the tilt shaft along an outer surface of a transom of a hull. A distance between the tilt shaft and the trim cylinder shaft is adjustable.

In an outboard motor movement mechanism according to a preferred embodiment of the present invention, the distance between the tilt shaft and the trim cylinder shaft is adjustable such that when the distance between the tilt shaft and the trim cylinder shaft is increased, the entire trim and tilt operating ranges are changed to the negative side, and when the distance between the tilt shaft and the trim cylinder shaft is decreased, the entire trim and tilt operating ranges are changed to the positive side. That is, the trim and tilt operating ranges are flexibly changed according to the type of marine vessel.

An outboard motor movement mechanism according to a preferred embodiment of the present invention preferably further includes a mount attached to the outer surface of the transom and that rotatably supports each of the tilt shaft and the trim cylinder shaft. Accordingly, the attachment position of each of the tilt shaft and the trim cylinder shaft with respect to the transom is easily changed by the mount, and thus the trim and tilt operating ranges are more flexibly changed according to the type of marine vessel.

In such a case, the mount preferably includes a first support that rotatably supports the tilt shaft, and a second support provided separately from the first support and that rotatably supports the trim cylinder shaft, and the distance between the tilt shaft and the trim cylinder shaft is preferably adjusted by changing a relative position between the first support and the second support in an upward-downward direction. Accordingly, the tilt shaft and the trim cylinder shaft are attached to the transom independently of each other by the first support and the second support which are different from each other, and thus the attachment position of each of the tilt shaft and the trim cylinder shaft with respect to the transom is more easily changed. Consequently, the trim and the tilt operating ranges are more flexibly changed according to the type of marine vessel.

An outboard motor movement mechanism including the mount preferably further includes a position adjuster provided in the mount and that changes a position of at least one of the tilt shaft and the trim cylinder shaft in the upward-downward direction with respect to the transom by changing a position of at least one of the first support and the second support in the upward-downward direction. Accordingly, the position of at least one of the tilt shaft and the trim cylinder shaft in the upward-downward direction with respect to the transom is easily changed by the position adjuster.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings.

First Preferred Embodiment

The structure of a marine vessel 100 including an outboard motor 10 according to a first preferred embodiment of the present invention is now described with reference to FIGS. 1 to 6.

In the figures, arrow FWD represents the forward movement direction of the marine vessel 100, and arrow BWD represents the reverse movement direction of the marine vessel 100. In addition, in the figures, arrow R represents the starboard direction of the marine vessel 100, and arrow L represents the portside direction of the marine vessel 100.

Figure 1:
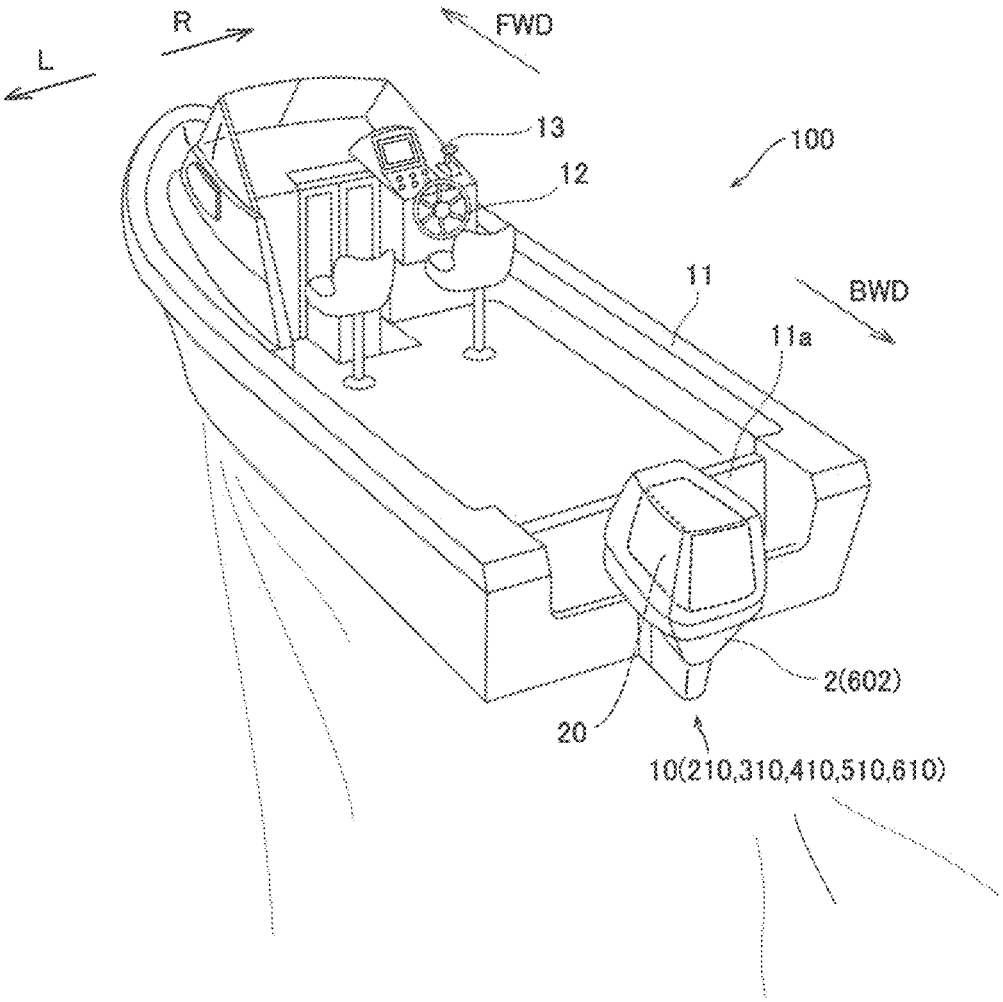
FIG. 1 is a perspective view schematically showing a marine vessel including an outboard motor according to a first preferred embodiment (second to sixth preferred embodiments) of the present invention.

As shown in FIG. 1, the marine vessel 100 includes the outboard motor 10, a hull 11, a steering wheel 12, and a remote control 13.

The steering wheel 12 is operated to steer the hull 11 (steer the outboard motor 10). Specifically, the steering wheel 12 is connected to a steering (not shown) of the outboard motor 10. The outboard motor 10 is rotated in a horizontal direction by the steering based on the operation of the steering wheel 12.

The remote control 13 is operated to switch the shift state (the forward movement state, reverse movement state, or neutral state) and change the output (throttle opening degree) of the outboard motor 100. Specifically, the remote control 13 is connected to an engine 20 (see FIG. 2) and a shift actuator (see FIG. 2) of the outboard motor 10. The output and shift state of the engine 20 of the outboard motor 10 are controlled based on the operation of the remote control 13.

Figure 2:
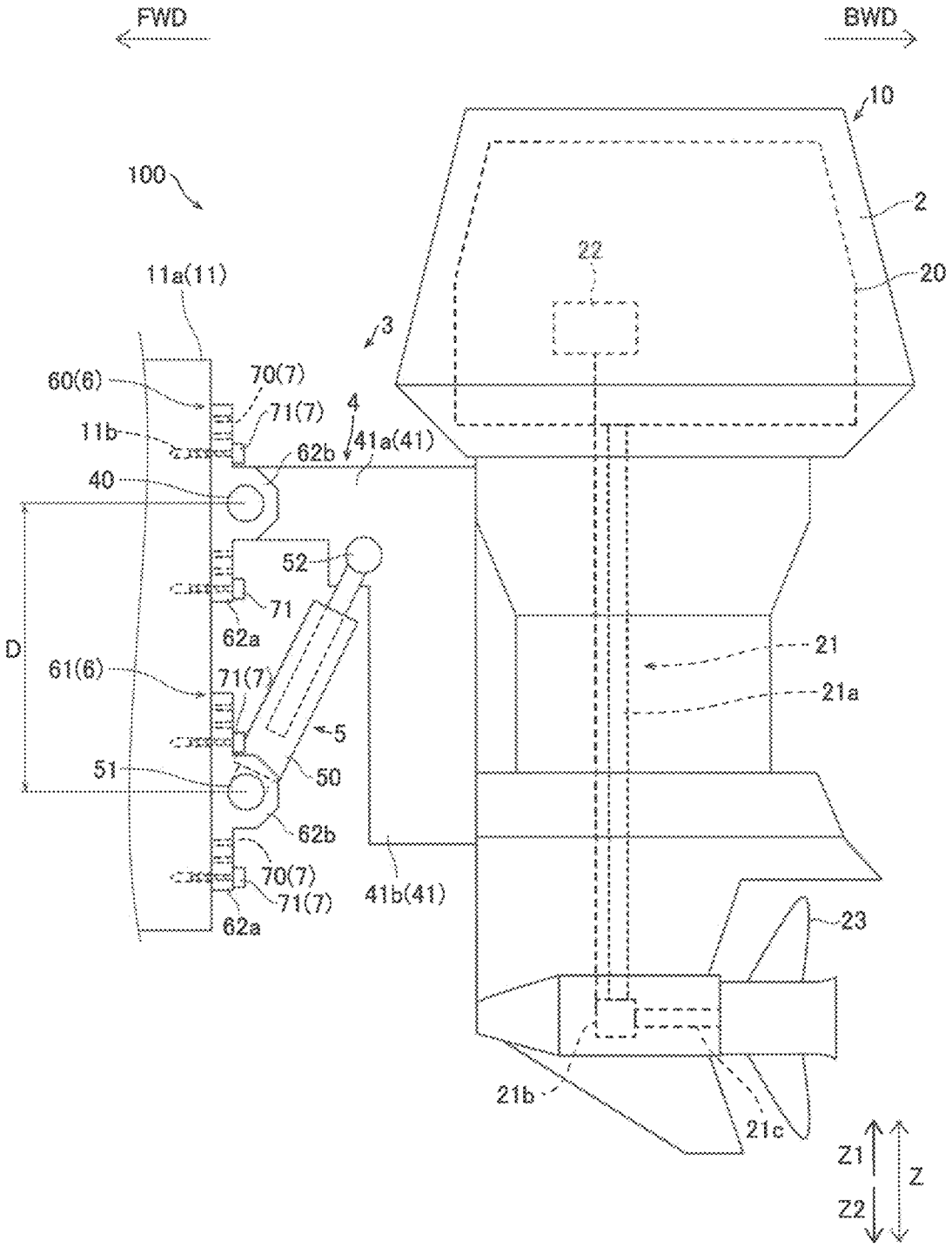
FIG. 2 is a side view showing the outboard motor according to the first preferred embodiment of the present invention.

As shown in FIG. 2, the outboard motor 10 includes an outboard motor main body 2, an outboard motor movement mechanism 3 that attaches the outboard motor main body 2 to the hull 11, and a steering shaft (not shown).

The steering shaft is provided in the outboard motor main body 2 and is supported by the outboard motor movement mechanism 3. The outboard motor main body 2 is steerable to the left and right about the steering shaft. The outboard motor main body 2 is attached to the rear (transom 11*a*) of the hull 11 via the steering shaft and the outboard motor movement mechanism 3.

The outboard motor 10 (outboard motor movement mechanism 3) according to the first preferred embodiment is able to change (adjust) a distance D between a tilt shaft 40 (a rotation central shaft of the outboard motor main body 2 that extends in the horizontal direction) and a first trim cylinder shaft 51. The first trim cylinder shaft 51 is a rotational shaft disposed at the front end of a trim cylinder 5 and is disposed below the tilt shaft 40 along the outer surface of the transom 11*a* of the hull 11.

Thus, the outboard motor 10 (outboard motor movement mechanism 3) is able to change the trim and tilt operating ranges (the upper and lower limit angles of the variation range of the inclination angle of the outboard motor main body 2 with respect to the horizontal direction by the trim cylinder 5) of the outboard motor main body 2. The details are described below.

As shown in FIG. 2, the outboard motor main body 2 is attached to the hull 11 (transom 11*a*) so as to be rotatable about an axis in the horizontal direction by the outboard motor movement mechanism 3.

The outboard motor main body 2 includes the engine 20, a power transmission 21, the shift actuator 22, and a propeller 23 (screw).

The engine 20 is provided in an upper portion of the outboard motor 10, and preferably is an internal combustion engine driven by explosive combustion of gasoline, light oil, or the like. The engine 20 is covered by an engine cover.

The power transmission 21 transmits the driving force of the engine 20 to the propeller 23. The power transmission 21 includes a drive shaft 21*a*, a gearing 21*b*, and a propeller shaft 21*c*.

The drive shaft 21*a* is connected to a crankshaft (not shown) of the engine 20 so as to transmit the power of the engine 20. The drive shaft 21*a* extends in an upward-downward direction (Z direction).

The gearing 21*b* is disposed at a lower end of the drive shaft 21*a* in a lower portion of the outboard motor 10. The gearing 21*b* transmits the rotation of the drive shaft 21*a* to the propeller shaft 21*c*. That is, the gearing 21*b* transmits the driving force of the drive shaft 21*a* that rotates about a rotation axis that extends in the upward-downward direction to the propeller shaft 21*c* that rotates about a rotation axis that extends in a forward-rearward direction.

The shift actuator 22 switches the shift state of the outboard motor 10 based on the user's operation. Specifically, the shift actuator 22 changes the shift position to any of forward movement, reverse movement, and neutral by changing the meshing of the gearing 21*b* based on the user's operation.

The propeller 23 is connected to the propeller shaft 21*c*, and is rotationally driven about the rotation axis that extends in the forward-rearward direction. The propeller 23 moves the hull 11 forward or reversely by rotating in the water to generate a thrust force in an axial direction.

A trim angle that enables generation of an optimum thrust force by the propeller 23 and enhancement of the stability of the hull 11 is varied according to the shape of the hull 11, for example. Even when the trim angle that enables generation of an optimum thrust force and enhancement of the stability of the hull 11 is not within the set trim operating range, the outboard motor movement mechanism 3 changes the trim operating range of the outer motor main body 2 such that the angle of the propeller 23 is adjusted to an optimum value. The details are described below.

As shown in FIG. 2, the outboard motor movement mechanism 3 includes a support 4, a trim cylinder 5 disposed below the support 4, and a mount 6 attached to the outer surface of the transom 11*a*. The mount 6 includes first supports 60 and second supports 61 disposed side by side in the upward-downward direction.

The support 4 (pivoting member 41) supports the outboard motor main body 2 via the steering shaft (not shown).

The support 4 includes the tilt shaft 40 and an L-shaped pivoting member 41 that pivots about the tilt shaft 40.

The tilt shaft 40 extends in the horizontal direction and a right-left direction, and functions as the rotation central shaft of the outboard motor main body 2 when the trim angle and the tilt angle are changed. The tilt shaft 40 is rotatably supported by the first supports 60 of the mount 6. The position of the tilt shaft 40 in the upward-downward direction is changed (adjusted) along the outer surface of the transom 11*a* by position adjusters 7 (described below) provided in the first supports 60. The position of the tilt shaft 40 in the upward-downward direction is changed (adjusted) along the outer surface of the transom 11*a* by the position adjusters 7 when the marine vessel is not moving or under way (when the engine 20 is stopped).

The pivoting member 41 includes a first portion 41*a* that extends rearward from the tilt shaft 40 and a second portion 41*b* that extends downward from a rear end of the first portion 41*a*, and preferably is L-shaped and defined by the first portion 41*a* and the second portion 41*b*. The first portion 41*a* and the second portion 41*b* both extend linearly. Furthermore, the second portion 41*b* extends in the same direction as the outboard motor main body 2 along the outboard motor main body 2. That is, in a state in which the second portion 41*b* extends in a vertical direction, the outboard motor main body 2 also extends in a substantially vertical direction (the trim angle is zero or substantially zero).

The pivoting member 41 is pivotally supported by a second trim cylinder shaft 52 of the trim cylinder 5 disposed in the vicinity of or adjacent to a connection location (L-shaped corner) between the first portion 41*a* and the second portion 41*b*. The second trim cylinder shaft 52 is a rotational shaft disposed at a rear end of the trim cylinder 5. That is, the second trim cylinder shaft 52 is spaced farther apart from the transom 11*a* of the hull 11 than the first trim cylinder shaft 51. The pivoting member 41 pivots about the tilt shaft 40 due to expansion and contraction of the trim cylinder 5.

As shown in FIG. 2, the trim cylinder 5 includes a cylinder body 50, the first trim cylinder shaft 51 disposed at the front end of the cylinder body 50 described above, and the second trim cylinder shaft 52 disposed at the rear end of the cylinder body 50 described above.

Both the first trim cylinder shaft 51 and the second trim cylinder shaft 52 extend in the horizontal direction and the right-left direction, and define rotation central shafts of the cylinder body 50. The cylinder body 50 includes a cylindrical member and a rod having a variable amount of protrusion from the cylindrical member, and is linearly expandable and contractable. The second trim cylinder shaft 52 is disposed in the vicinity of or adjacent to the connection location between the first portion 41*a* and the second portion 41*b* of the pivoting member 41 (support 4), and is disposed above the first trim cylinder shaft 51. That is, the cylinder body 50 extends upward.

The first trim cylinder shaft 51 is rotatably supported by the second supports 61 of the mount 6. Similar to the tilt shaft 40, the position of the first trim cylinder shaft 51 in the upward-downward direction is changed (adjusted) along the outer surface of the transom 11*a* by position adjusters 7 (described below) provided in the second supports 61. The position of the first trim cylinder shaft 51 in the upward-downward direction is changed (adjusted) along the outer surface of the transom 11*a* by the position adjusters 7 when the marine vessel is not moving or under way (when the engine 20 is stopped).

Figure 3:
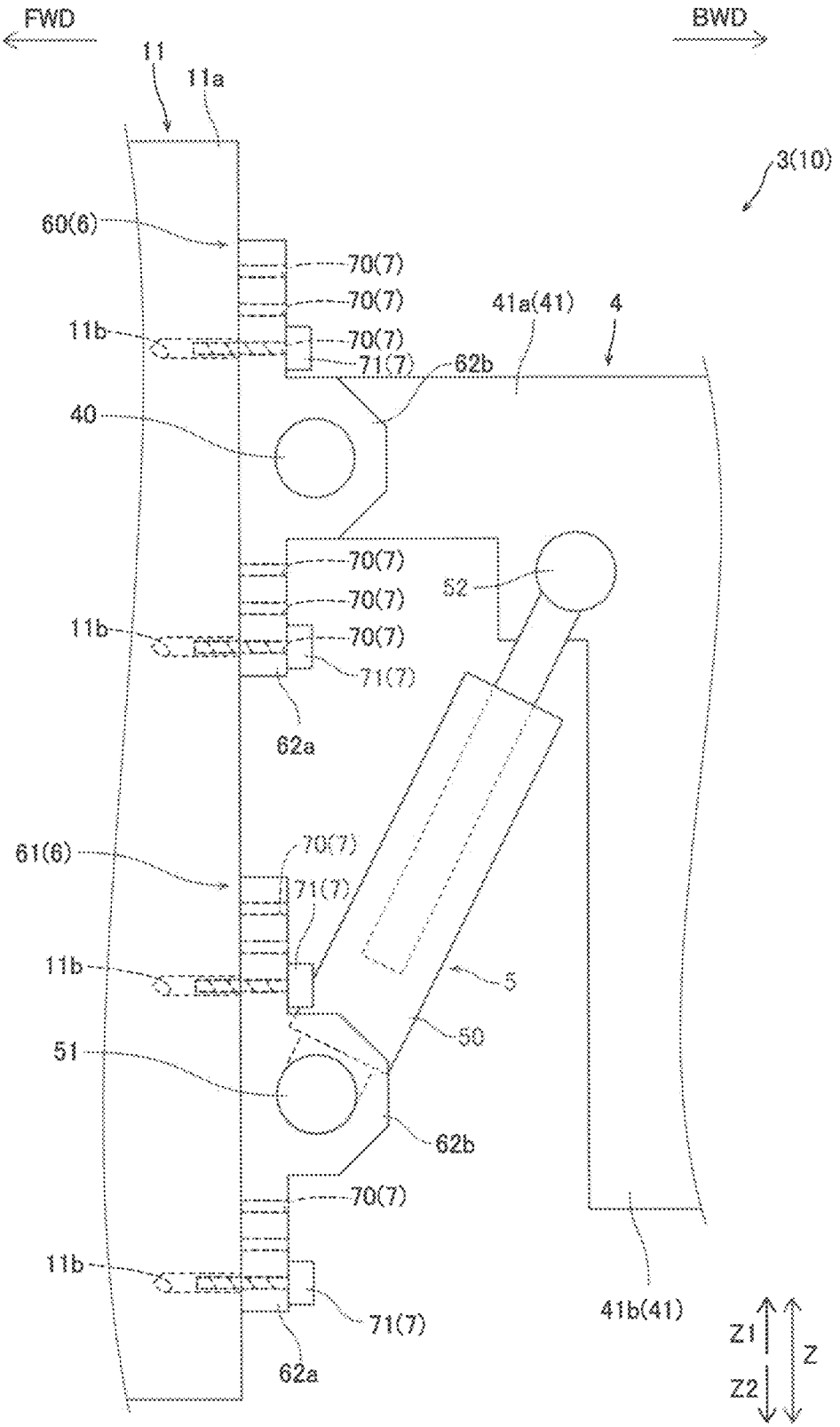
FIG. 3 is a side view showing an outboard motor movement mechanism according to the first preferred embodiment of the present invention.
Figure 4:
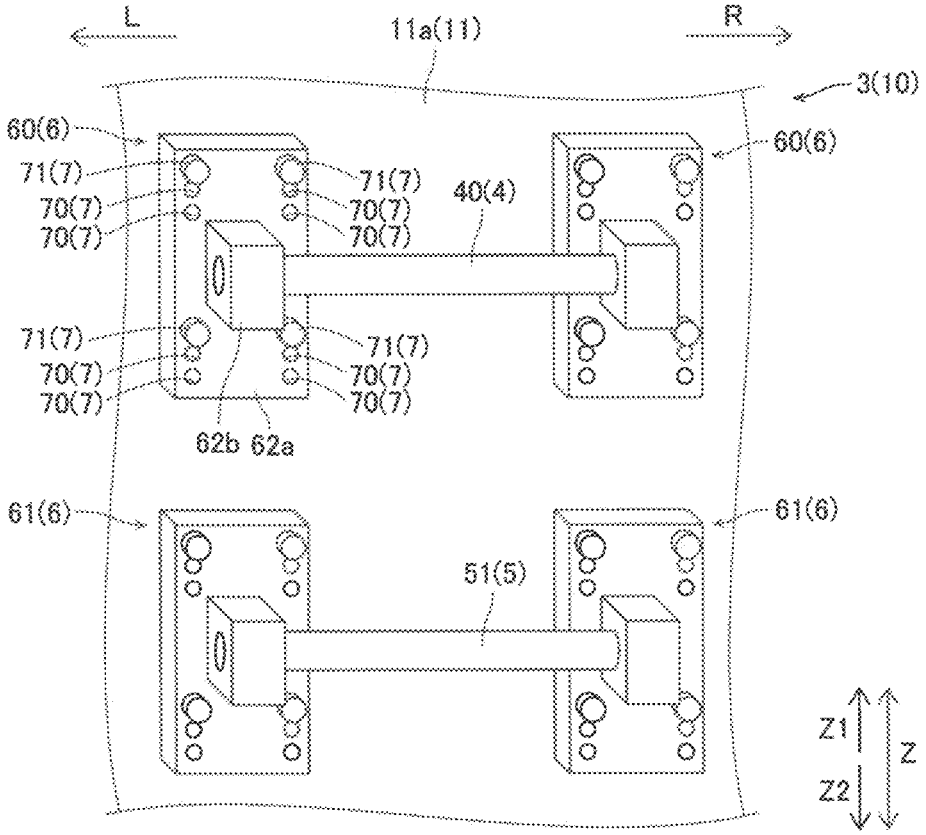
FIG. 4 is a perspective view showing a mount, a trim shaft, and a tilt shaft of the outboard motor movement mechanism according to the first preferred embodiment of the present invention.

As shown in FIG. 3, the mount 6 is attached to the outer surface of the transom 11*a*, and rotatably supports each of the tilt shaft 40 and the first trim cylinder shaft 51. That is, the mount 6 is a member that attaches the support 4, the trim cylinder 5, and the outboard motor main body 2 (see FIG. 2) to the hull 11.

As described above, the mount 6 includes the first supports 60 that rotatably support the tilt shaft 40 and the second supports 61 provided separately from the first supports 60 and that rotatably support the first trim cylinder shaft 51.

The outboard motor movement mechanism 3 changes (adjusts) the distance D (see FIG. 2) between the tilt shaft 40 and the first trim cylinder shaft 51 by changing relative positions between the first supports 60 and the second supports 61 in the upward-downward direction.

Thus, the outboard motor movement mechanism 3 is able to adjust the trim and tilt operating ranges. Specifically, the outboard motor movement mechanism 3 raises both the upper and lower limits of the trim and tilt operating ranges by predetermined values, or lowers both the upper and lower limits of the trim and tilt operating ranges by predetermined values.

The outboard motor movement mechanism 3 changes the positions of the first supports 60 and the second supports 61 attached to the hull 11 upward or downward by predetermined distances such that the heights of the support 4, the trim cylinder 5, and the outboard motor main body 2 are changed upward or downward while the predetermined trim and tilt operating ranges of the outboard motor main body 2 are maintained. The positions (the positions in the upward-downward direction) of the first supports 60 and the second supports 61 attached to the hull 11 are changed by the position adjusters 7 described below.

The first supports 60 each include a flat plate 62*a* disposed along the outer surface of the transom 11*a*, and a cylindrical protrusion 62*b* that protrudes rearward from an intermediate position of the flat plate 62*a* in the upward-downward direction and supports the tilt shaft 40. The first supports 60 are directly attached to the transom 11*a* while being in contact with the transom 11*a*. A pair of first supports 60 are provided side by side in the right-left direction so as to rotatably support the tilt shaft 40. That is, the pair of first supports 60 are spaced apart from each other by a predetermined distance in the right-left direction, and respectively support a first end and a second end of the tilt shaft 40.

The second supports 61 preferably have the same shapes as those of the first supports 60. Specifically, the second supports 61 each include a rectangular flat plate 62*a* disposed along the outer surface of the transom 11*a*, and a cylindrical protrusion 62*b* that protrudes rearward from an intermediate position of the flat plate 62*a* in the upward-downward direction and supports the first trim cylinder shaft 51. The second supports 61 are directly attached to the transom 11*a* while being in contact with the transom 11*a*. A pair of second supports 61 are provided side by side in the right-left direction so as to rotatably support the first trim cylinder shaft 51. That is, the pair of second supports 61 are spaced apart from each other by a predetermined distance in the right-left direction, and respectively support a first end and a second end of the first trim cylinder shaft 51.

As shown in FIG. 3, the position adjusters 7 that change the positions of the tilt shaft 40 and the first trim cylinder shaft 51 in the upward-downward direction with respect to the transom 11*a* by changing the positions of the first supports 60 and the second supports 61 in the upward-downward direction are provided in the mount 6.

The position adjusters 7 each include a plurality of (three, for example) holes 70 provided in the flat plate 62*a* of each of the first supports 60 and aligned in the upward-downward direction, and a fastener 71 inserted into one of the plurality of holes 70 and that fixes the first support 60 to the transom 11*a*.

The plurality of (three) holes 70 are aligned at equal or substantially equal intervals in the upward-downward direction. Each of the plurality of holes 70 extends in the forward-rearward direction (the thickness direction of the flat plate 62*a*), and passes through the flat plate 62*a*. The plurality of holes 70 are provided in pairs in the right-left direction (see FIG. 4). In addition, a set of the plurality of holes 70 provided in pairs in the right-left direction is provided both above and below the protrusion 62*b* of each of the first supports (see FIG. 4).

The fastener 71 includes, for example, a bolt. The transom 11*a* includes mounting holes 11*b* each including a female screw, through which the fastener 71 is attached. One mounting hole 11*b* is provided for the plurality of (three) holes 70 provided in the mount 6. Therefore, the mounting holes 11*b* for attaching the first supports 60 are respectively provided above and below the protrusion 62*b* of each of the first supports 60. A distance between the mounting hole 11*b* above the protrusion 62*b* and the mounting hole 11*b* below the protrusion 62*b* is equal to a distance between the highest (or middle or lowest) hole of the plurality of holes 70 on the upper side and the highest (or middle or lowest) hole of the plurality of holes 70 on the lower side.

Furthermore, the position adjusters 7 each include a plurality of (three, for example) holes 70 provided in the flat plate 62*a* of each of the second supports 61 and aligned in the upward-downward direction, and a fastener 71 inserted into one of the plurality of holes 70 and that fixes the second support 61 to the transom 11*a*. The structure of the position adjusters 7 that change the heights of the second supports 61 is similar to the structure of the position adjusters 7 that change the heights of the first supports 60, and thus detailed description thereof is omitted.

The operation of the position adjusters 7 to change (adjust) the trim and tilt operating ranges of the outboard motor main body 2 (see FIG. 2) is now described with reference to (A) and (B) of FIG. 5. In (A) and (B) of FIG.

5 and (A) and (B) of FIG. 6 described below, the outboard motor main body 2 is omitted for the convenience of illustration.

The position adjusters 7 change the trim operating range of the outboard motor main body 2 by changing the relative positions between the first supports 60 that support the tilt shaft 40 and the second supports 61 that support the first trim cylinder shaft 51 in the upward-downward direction to change (adjust) the distance D (see FIG. 2) between the tilt axis 40 and the first trim cylinder shaft 51.

A specific non-limiting example is described below. (A) of FIG. 5 shows a state before changing the trim operating range, and (B) of FIG. 5 shows a state after changing the trim operating range. In both (A) and (B) of FIG. 5, the trim cylinder 5 is in the most contracted state.

As shown in (A) of FIG. 5, a pair of three holes 70 aligned in the upward-downward direction are respectively provided above and below the protrusion 62*b* in the flat plate 62*a* of the first support 60 (second support 61). The fastener 71 is attached to the lowest hole 70 of the three holes 70. That is, each of the first support 60 and the second support 61 is attached to the transom 11*a* by the fasteners 71. In the state shown in (A) of FIG. 5, the outboard motor main body 2 extends in the vertical direction. The distance between the tilt axis 40 and the first trim cylinder shaft 51 in the state shown in (A) of FIG. 5 is D1.

First, all the fasteners 71 attached to the second support 61 are removed such that the second support 61 is removed from the transom 11*a*.

Figure 5:
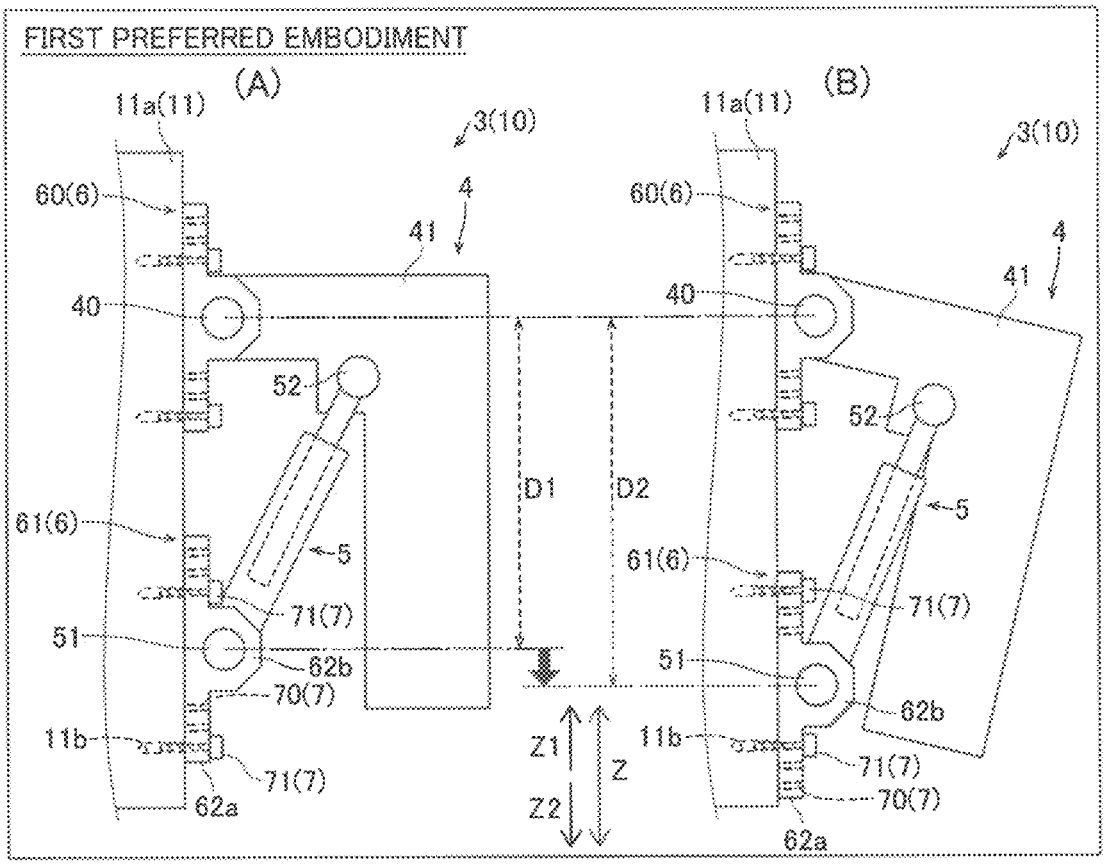
FIG. 5 is a diagram illustrating the operation of position adjusters of the outboard motor movement mechanism to change the trim and tilt operating ranges of an outboard motor main body.

Next, as shown in (B) OF FIG. 5, only the second support 61 is moved downward with respect to the transom 11*a*, and the highest holes 70 of the pair of three holes 70 aligned in the upward-downward direction in the second support 61 are placed at positions corresponding to the mounting holes 11*b* of the transom 11*a*.

Next, the second support 61 is attached to the transom 11*a* by the fasteners 71. That is, the distance between the tilt shaft 40 and the first trim cylinder shaft 51 is changed to D2 larger than the distance D1, and the second support 61 is attached to the transom 11*a*. In the state shown in (B) of FIG. 5, the position of the second trim cylinder shaft 52, which supports the pivoting member 41, in the upward-downward direction is lower than that in the state shown in (A) of FIG. 5, and thus the pivoting member 41 is inclined downward, and the tilt angle is changed to the negative side (both the upper and lower limits of the operating ranges are lowered).

The operation of the position adjusters 7 to change (adjust) the position of the outboard motor main body 2 (see FIG. 2) in the upward-downward direction is now described with reference to (A) and (B) of FIG. 6.

A specific non-limiting example is described below. (A) of FIG. 6 shows a state before changing the position of the outboard motor main body 2 in the upward-downward direction, and (B) of FIG. 6 shows a state after changing the position of the outboard motor main body 2 in the upward-downward direction. In both (A) and (B) of FIG. 6, the trim cylinder 5 is in the most contracted state. Moreover, the state of (A) of FIG. 6 is the same as that of (A) of FIG. 5, and thus description thereof is omitted.

First, all the fasteners 71 attached to the first support 60 and the second support 61 are removed such that both the first support 60 and the second support 61 are removed from the transom 11*a*.

Figure 6:
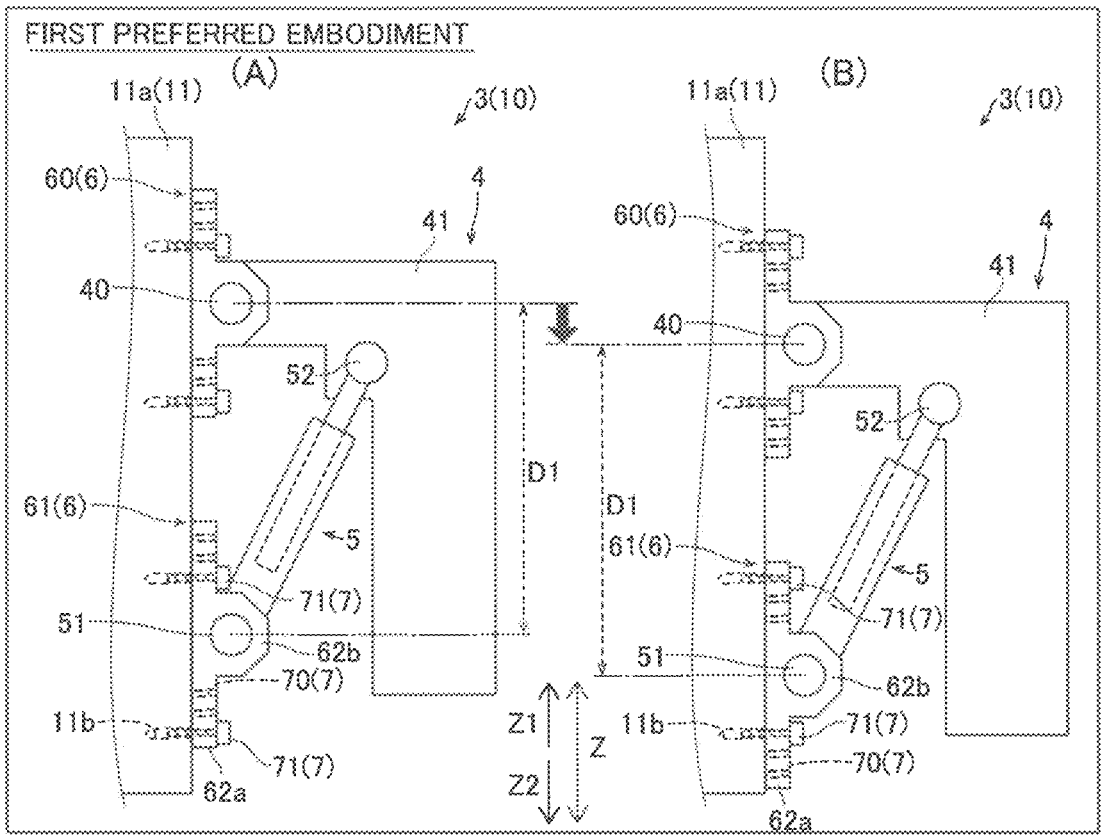
FIG. 6 is a diagram illustrating the operation of the position adjusters of the outboard motor movement mechanism to change the position of the outboard motor main body in an upward-downward direction.

Next, as shown in (B) of FIG. 6, both the first support 60 and the second support 61 are moved downward with respect to the transom 11*a*, and the highest holes 70 of the pair of three holes 70 aligned in the upward-downward direction in each of the first support 60 and the second support 61 are placed at positions corresponding to the mounting holes 11*b* of the transom 11*a*. That is, the first support 60 and the second support 61 are moved downward by the same distance.

Next, the first support 60 and the second support 61 are attached to the transom 11*a* by the fasteners 71. That is, the outboard motor main body 2 is moved downward while the trim angle of the outboard motor main body 2 is maintained without changing (adjusting) the distance D1 between the tilt shaft 40 and the first trim cylinder shaft 51, and the first support 60 and the second support 61 are attached to the transom 11*a*.

In (A) and (B) of FIG. 5 and (A) and (B) of FIG. 6, the example in which either the trim and tilt operating ranges of the outboard motor main body 2 or the position of the outboard motor main body 2 in the upward-downward direction is changed is illustrated. However, both the trim and tilt operating ranges of the outboard motor main body 2 and the height of the outboard motor main body 2 in the upward-downward direction may be simultaneously changed by making the amounts of movement of the first support 60 and the second support 61 different from each other.

According to the first preferred embodiment of the present invention, the following advantageous effects are achieved.

According to the first preferred embodiment of the present invention, the distance between the tilt shaft 40 and the first trim cylinder shaft 51 is adjustable such that when the distance between the tilt shaft 40 and the first trim cylinder shaft 51 is increased, both the upper and lower limits of the trim and tilt operating ranges are lowered, and when the distance between the tilt shaft 40 and the first trim cylinder shaft 51 is decreased, both the upper and lower limits of the trim and tilt operating ranges are raised. That is, the trim and tilt operating ranges are flexibly changed according to the type of marine vessel. The term "trim and tilt operating ranges" does not indicate the angular range of the outboard motor main body 2 restricted (defined) by a limiting device (limiting mechanism) that restricts rotation of the outboard motor main body 2, but indicates the angular range of the outboard motor main body 2 defined by the attachment positions (arrangements) of the first trim cylinder shaft 51 and the tilt shaft 40 in a state in which the limiting device (limiting mechanism) does not restrict rotation of the outboard motor main body 2, and the angular range of the outboard motor main body 2 between the upper limit and the lower limit of the inclination angle of the outboard motor main body 2 about the tilt shaft 40.

According to the first preferred embodiment of the present invention, the outboard motor 10 includes the mount 6 attached to the outer surface of the transom 11*a* and that rotatably supports each of the tilt shaft 40 and the first trim cylinder shaft 51. Accordingly, the attachment position of each of the tilt shaft 40 and the first trim cylinder shaft 51 with respect to the transom 11*a* is easily changed by the mount 6, and thus the trim and tilt operating ranges are more flexibly changed according to the type of marine vessel.

According to the first preferred embodiment of the present invention, the mount 6 includes the first supports 60 that rotatably support the tilt shaft 40 and the second supports 61 provided separately from the first supports 60 and that rotatably support the first trim cylinder shaft 51, and the distance between the tilt shaft 40 and the first trim cylinder shaft 51 is adjusted by changing the relative positions between the first supports 60 and the second supports 61 in the upward-downward direction. Accordingly, the tilt shaft 40 and the first trim cylinder shaft 51 are attached to the transom 11*a* independently of each other by the first supports 60 and the second supports 61 which are different from each other, and thus the attachment position of each of the tilt shaft 40 and the first trim cylinder shaft 51 with respect to the transom 11*a* is more easily changed. Consequently, the trim and the tilt operating ranges are more flexibly changed according to the type of marine vessel.

According to the first preferred embodiment of the present invention, the outboard motor 10 includes the position adjusters 7 provided in the mount 6 and that change the position of at least one of the tilt shaft 40 and the first trim cylinder shaft 51 in the upward-downward direction with respect to the transom 11*a* by changing the positions of at least one of the first supports 60 and the second supports 61 in the upward-downward direction. Accordingly, the position of at least one of the tilt shaft 40 and the first trim cylinder shaft 51 in the upward-downward direction with respect to the transom 11*a* is easily changed by the position adjusters 7.

According to the first preferred embodiment of the present invention, the position adjusters 7 each include the plurality of holes 70 provided in the first support 60 and the second support 61 and aligned in the upward-downward direction, and the fastener 71 inserted into one of the plurality of holes 70 and that fixes the first support 60 and the second support 61 to the transom 11*a* so as to maintain the positions of the tilt shaft 40 and the first trim cylinder shaft 51 in the upward-downward direction with respect to the transom 11*a*. Accordingly, the first support 60 and the second support 61 are easily attached and removed by using the fastener 71. Furthermore, attachment of the first support 60 and the second support 61 to one of the plurality of holes 70 is reliably maintained by the fastener 71.

According to the first preferred embodiment of the present invention, the pair of first supports 60 are provided side by side in the right-left direction so as to rotatably support the tilt shaft 40, and the pair of second supports 61 are provided side by side in the right-left direction so as to rotatably support the first trim cylinder shaft 51. Accordingly, the tilt shaft 40 and the first trim cylinder shaft 51 are more securely supported by the first supports 60 and the second supports 61 as compared with the case in which only the longitudinal centers of the tilt shaft 40 and the first trim cylinder shaft 51 are supported.

According to the first preferred embodiment of the present invention, the trim cylinder 5 includes the second trim cylinder shaft 52 disposed at the rear end of the trim cylinder 5, and the support 4 includes the first portion 41*a* that extends rearward from the tilt shaft 40 and the second portion 41*b* that extends downward from the rear end of the first portion 41*a*, preferably is L-shaped defined by the first portion 41*a* and the second portion 41*b*, and is rotatably supported by the second trim cylinder shaft 52. Accordingly, the second portion 41*b* of the L-shaped support 4 is disposed along the outboard motor main body 2, and thus the support 4 securely supports the outboard motor main body 2.

According to the first preferred embodiment of the present invention, the second trim cylinder shaft 52 is disposed in the vicinity of or adjacent to the connection location between the first portion 41*a* and the second portion 41*b*, and is disposed above the first trim cylinder shaft 51. Accordingly, a load that acts on the connection location (L-shaped corner) between the first portion 41*a* and the second portion 41*b* is reduced as compared with the case in which the second trim cylinder shaft 52 is disposed in the vicinity of the second portion 41*b* away from the first portion 41*a*.

Second Preferred Embodiment

A second preferred embodiment of the present invention is now described with reference to FIGS. 1 and 7. According to the second preferred embodiment, first supports 60 and second supports 61 are indirectly attached to a transom 11*a* via a base plate 263, unlike the first preferred embodiment in which the first supports 60 and the second supports 61 are directly attached to the transom 11*a*. In the second preferred embodiment, the same structures as those of the first preferred embodiment are denoted by the same reference numerals, and description thereof is omitted.

Figure 7:
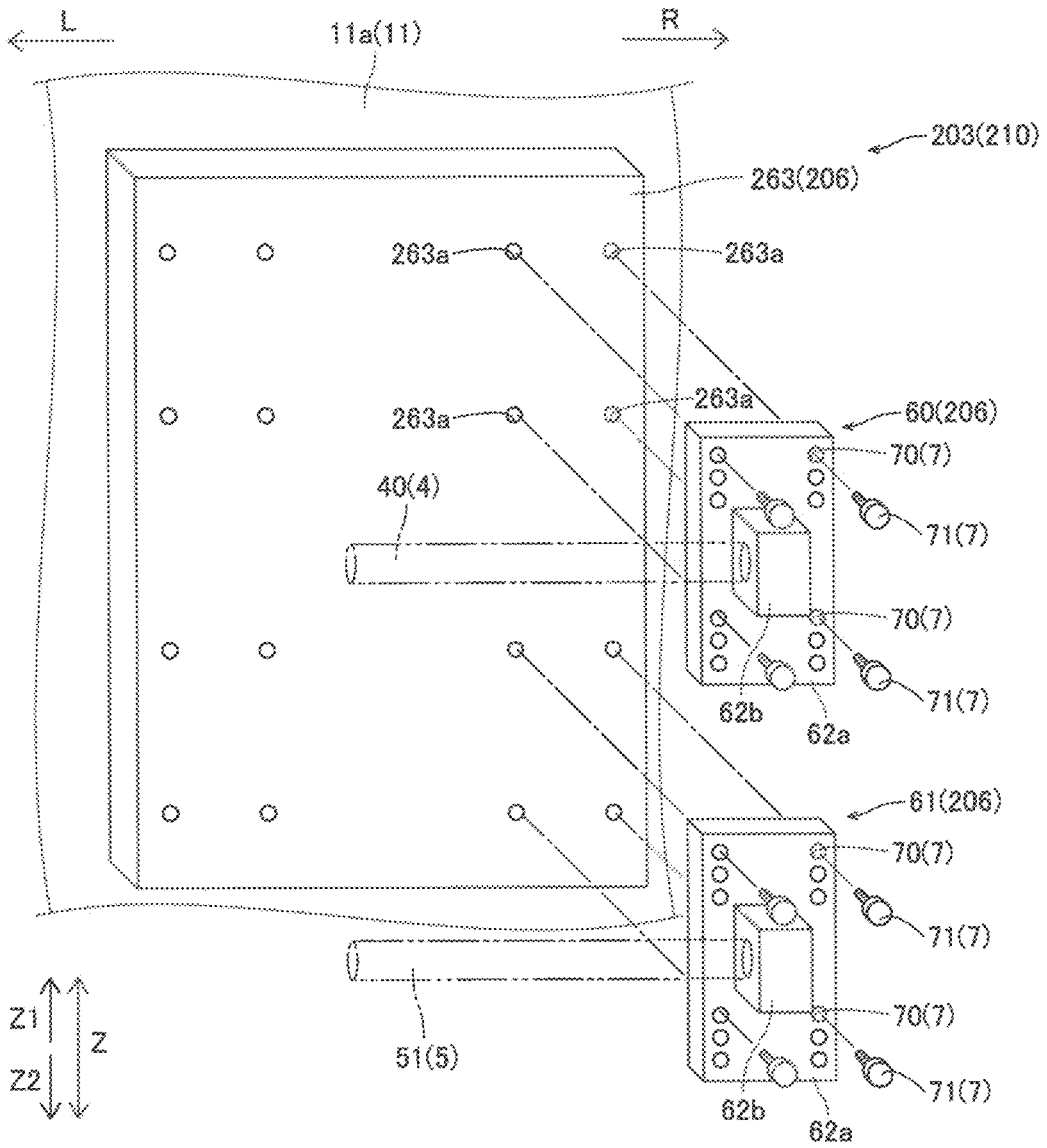
FIG. 7 is a perspective view showing a mount, a trim shaft, and a tilt shaft of an outboard motor movement mechanism according to the second preferred embodiment of the present invention.

As shown in FIG. 1, an outboard motor 210 according to the second preferred embodiment includes an outboard motor main body 2 and an outboard motor movement mechanism 203 (see FIG. 7).

As shown in FIG. 7, the outboard motor movement mechanism 203 includes a support 4, a trim cylinder 5 disposed below the support 4, and a mount 206 attached to the outer surface of the transom 11*a*.

The mount 206 includes the first supports 60 and the second supports 61 disposed side by side in an upward-downward direction, and the base plate 263.

The base plate 263 preferably has a rectangular flat plate shape. The base plate 263 is attached to the transom 11*a* along the transom 11*a*. Specifically, the base plate 263 includes holes (not shown) through which bolts pass, and is attached to the transom 11*a* by the bolts.

The first supports 60 and the second supports 61 are installed on the base plate 263 such that the first supports 60 and the second supports 61 are independently repositionable relative to each other in the upward-downward direction. That is, the base plate 263 includes mounting holes 263*a* as structures corresponding to the mounting holes 11*b* (see FIG. 3) provided in the transom 11*a* according to the first preferred embodiment.

The outboard motor movement mechanism 203 changes (adjusts) a distance between a tilt shaft 40 and a first trim cylinder shaft 51 by changing the attachment positions of the first supports 60 and the second supports 61 with respect to the base plate 263 to change the relative positions between the first supports 60 and the second supports 61 in the upward-downward direction.

The remaining structures of the second preferred embodiment are similar to those of the first preferred embodiment.

According to the second preferred embodiment of the present invention, the following advantageous effects are achieved.

According to the second preferred embodiment of the present invention, the mount 206 includes the base plate 263 attached to the transom 11*a* and on which the first supports 60 and the second supports 61 are installed such that the first supports 60 and the second supports 61 are independently repositionable relative to each other in the upward-downward direction. Accordingly, the base plate 263 is attached to the transom 11*a* such that the first supports 60 and the second supports 61 are indirectly attached to the transom 11*a*, and thus the attachment positions of the first supports 60 and the second supports 61 with respect to the base plate 263 are changed. Therefore, even before the first supports 60 and the second supports 61 are attached to the hull 11, the attachment position of each of the tilt shaft 40 and the first trim cylinder shaft 51 with respect to the transom 11*a* is changed (adjusted). That is, the trim and tilt operating ranges are easily changed.

The remaining advantageous effects of the second preferred embodiment are similar to those of the first preferred embodiment.

Third Preferred Embodiment

A third preferred embodiment of the present invention is now described with reference to FIGS. 1 and 8. According to the third preferred embodiment, a position adjuster 307 including a spacer mount 373 and a spacer 374 changes (adjusts) a distance between a tilt shaft 40 and a first trim cylinder shaft 51, unlike the first preferred embodiment in which the distance between the tilt shaft 40 and the first trim cylinder shaft 51 is changed (adjusted) by the position adjusters 7 each including the plurality of holes 70 and the fastener 71. In the third preferred embodiment, the same structures as those of the first preferred embodiment are denoted by the same reference numerals, and description thereof is omitted.

Figure 8:
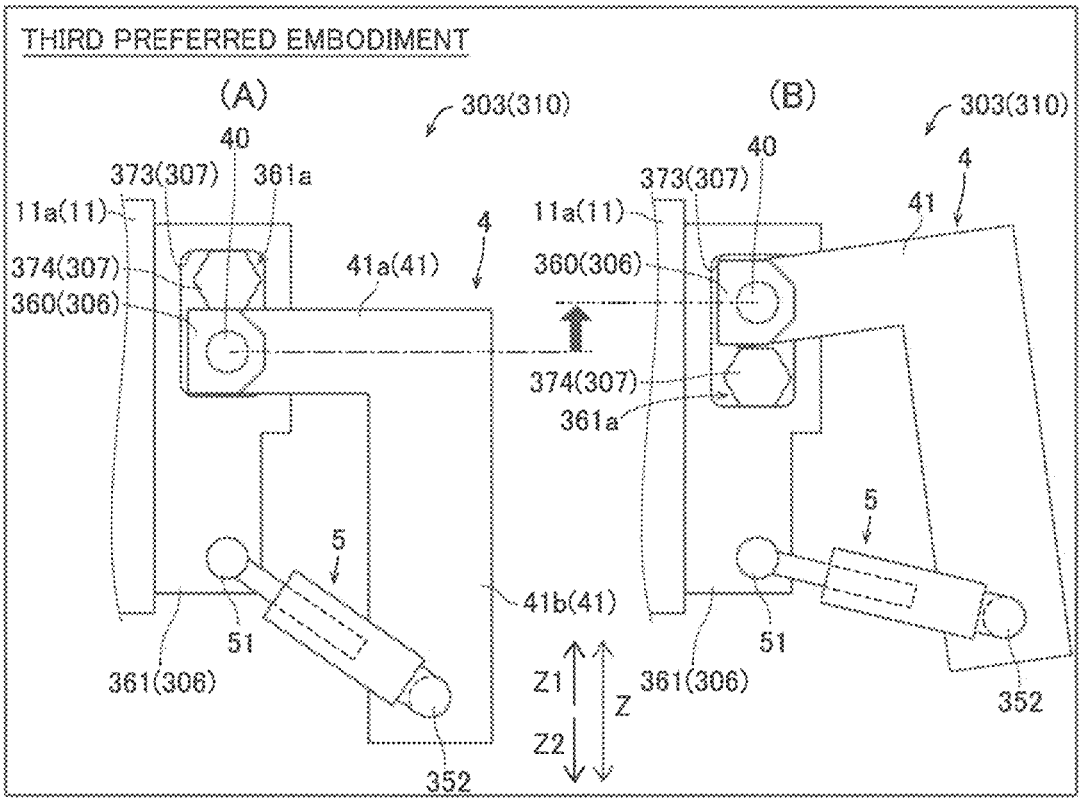
FIG. 8 is a side view showing an outboard motor movement mechanism according to the third preferred embodiment of the present invention.

As shown in FIG. 1, an outboard motor 310 according to the third preferred embodiment includes an outboard motor main body 2 and an outboard motor movement mechanism 303 (see (A) of FIG. 8).

As shown in (A) of FIG. 8, the outboard motor movement mechanism 303 includes a support 4, a trim cylinder 5 disposed below the support 4, and a mount 306 attached to the outer surface of a transom 11*a*.

The mount 306 includes first supports 360 that rotatably support the tilt shaft 40 and a second support 361 that rotatably supports the first trim cylinder shaft 51. The second support 361 is attached to the transom 11*a*. The second support 361 may be attached to the transom 11*a* indirectly via a base plate 263 (see FIG. 7) as described in the second preferred embodiment.

The first supports 360 each have a cylindrical shape corresponding to the shape of only the protrusion 62*b* (see FIG. 3) of each of the first supports 60 described in the first preferred embodiment. A pair of first supports 360 are provided side by side in a right-left direction so as to support opposite ends of the tilt shaft 40.

The second support 361 preferably has a flat plate shape that extends along the transom 11*a*. The second support 361 includes a through-hole 361*a* through which the tilt shaft 40 is inserted and in which the spacer 374 described below is disposed. The through-hole 361*a* is disposed above the first trim cylinder shaft 51. The through-hole 361*a* preferably has a rectangular shape that extends in an upward-downward direction, as viewed in a direction (right-left direction) in which the through-hole 361*a* extends. The through-hole 361*a* functions as the position adjuster 307 described below.

The position adjuster 307 that changes the position of the tilt shaft 40 in the upward-downward direction with respect to the transom 11*a* by changing the positions of the first supports 360 in the upward-downward direction is provided in the mount 306.

The position adjuster 307 includes the spacer mount 373 and the spacer 374.

The spacer mount 373 is provided in the second support 361, and the first supports 360 are disposed in the spacer mount 373 so as to be movable in the upward-downward direction. Specifically, the spacer mount 373 is defined by the annular inner surface of the through-hole 361*a* inside the second support 361.

The spacer 374 is disposed above or below the first supports 360 in the spacer mount 373 in contact with the first supports 360 and the second support 361, and maintains the position of the tilt shaft 40 in the upward-downward direction with respect to the transom 11*a*.

(A) of FIG. 8 shows a state in which the spacer 374 is disposed above the first supports 360. When the spacer 374 is moved below the first supports 360 such that the state of (A) of FIG. 8 is changed (adjusted) to a state shown in (B) of FIG. 8, the first supports 360 and the tilt shaft 40 are moved upward, and the distance between the tilt shaft 40 and the first trim cylinder shaft 51 is increased. That is, the trim and tilt operating ranges of the outboard motor main body 2 are changed to the positive side (both the upper and lower limits of the operating ranges are raised).

A second trim cylinder shaft 352 is disposed below the first trim cylinder shaft 51 when the trim cylinder 5 is in the most contracted state (the states shown in FIG. 8). Furthermore, the second trim cylinder shaft 352 supports the lower side of a second portion 41*b* of an L-shaped pivoting member 41.

The remaining structures of the third preferred embodiment are similar to those of the first preferred embodiment.

According to the third preferred embodiment of the present invention, the following advantageous effects are achieved.

According to the third preferred embodiment of the present invention, the position adjuster 307 includes the spacer mount 373 provided in the second support 361 and in which the first supports 360 are movable in the upward-downward direction, and the spacer 374 disposed above or below the first supports 360 in the spacer mount 373 in contact with the first supports 360 and the second support 361 and that maintains the position of the tilt shaft 40 in the upward-downward direction with respect to the transom 11*a*. Accordingly, the attachment positions of the first supports 360 are securely held by the spacer mount 373 and the spacer 374, and the trim and tilt operating ranges are easily changed.

The remaining advantageous effects of the third preferred embodiment are similar to those of the first preferred embodiment.

Fourth Preferred Embodiment

A fourth preferred embodiment of the present invention is now described with reference to FIGS. 1 and 9. According to the fourth preferred embodiment, a first support 460 includes a plurality of structures (a fixed portion 460*a* and a link 460*b*), unlike the first preferred embodiment in which the first supports 60 each includes a single structure. In the fourth preferred embodiment, the same structures as those of the first preferred embodiment are denoted by the same reference numerals, and description thereof is omitted.

Figure 9:
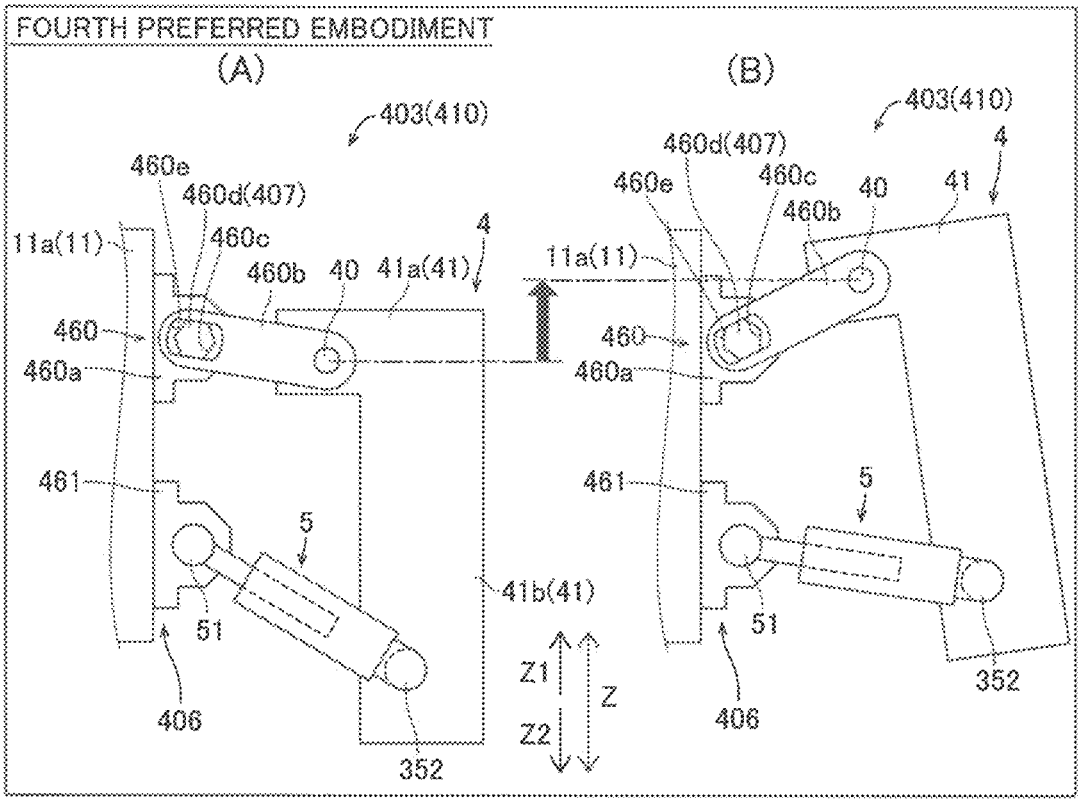
FIG. 9 is a side view showing an outboard motor movement mechanism according to the fourth preferred embodiment of the present invention.

As shown in FIG. 1, an outboard motor 410 according to the fourth preferred embodiment includes an outboard motor main body 2 and an outboard motor movement mechanism 403 (see (A) of FIG. 9).

As shown in (A) of FIG. 9, the outboard motor movement mechanism 403 includes a support 4, a trim cylinder 5 disposed below the support 4, and a mount 406 attached to the outer surface of a transom 11*a*.

The mount 406 includes the first support 460 that rotatably supports a tilt shaft 40 and second supports 461 that rotatably support a first trim cylinder shaft 51. The first support 460 and the second supports 461 are attached to the transom 11*a*. The first support 460 and the second supports 461 may be attached to the transom 11*a* indirectly via a base plate 263 (see FIG. 7) as described in the second preferred embodiment.

The second supports 461 preferably have the same shapes as those of the second supports 61 (see FIG. 3) described in the first preferred embodiment. The second supports 461 do not include a plurality of holes 70 (see FIG. 3) such as the holes 70 of the second supports 61.

The first support 460 includes the fixed portion 460*a* fixed to the transom 11*a*, and the link 460*b* including a front end supported by the fixed portion 460*a* and a rear end that rotatably supports the tilt shaft 40 of the support 4.

The fixed portion 460*a* has an appearance similar to those of the second supports 461. Furthermore, the fixed portion 460*a* includes a polygonal (e.g., hexagonal) through-hole 460*c* that penetrates in a right-left direction. The link 460*b* includes a polygonal rotation restricting shaft 460*d* inserted into the through-hole 460*c* at its front end. The rotation restricting shaft 460*d* is in surface contact with the inner surface of a through-hole 460*e* provided at the front end of the link 460*b*, and is held in a state in which the rotation is restricted. The rotation restricting shaft 460*d* functions as a position adjuster 407 described below.

The position adjuster 407 that changes the position of the tilt shaft 40 in an upward-downward direction with respect to the transom 11*a* by changing the position of the link 460*b* (rear end) of the first support 460 in the upward-downward direction is provided in the mount 406.

The position adjuster 407 includes the rotation restricting shaft 460*d*.

The rotation restricting shaft 460*d* has a polygonal shape (e.g., hexagonal shape), the longitudinal cross-sectional shape of which corresponds to the through-hole 460*c*. The rotation restricting shaft 460*d* is inserted in the through-hole 460*c* of the fixed portion 460*a* and the through-hole 460*e* of the link 460*b* in a state in which the rotation is restricted. Thus, the rotation restricting shaft 460*d* restricts rotation of the link 460*b* with respect to the fixed portion 460*a* by maintaining the angle of the link 460*b* at a predetermined angle, but is also able to change the predetermined angle.

The angle of the link 460*b* is changed by rotating the link 460*b* in a state in which the rotation restricting shaft 460*d* is removed. (B) of FIG. 9 shows a state after the link 460*b* is rotated such that the tilt shaft 40 moves upward from the state of (A) of FIG. 9. Thus, in the state of (B) of FIG. 9, a distance between the tilt shaft 40 and the first trim cylinder shaft 51 is increased as compared with the state of (A) of FIG. 9. That is, the trim and tilt operating ranges of the outboard motor main body 2 are changed to the positive side (both the upper and lower limits of the operating ranges are raised).

A second trim cylinder shaft 352 of the fourth preferred embodiment preferably has the same structure as that of the third preferred embodiment, and thus it is denoted by the same reference numeral, and description thereof is omitted.

The remaining structures of the fourth preferred embodiment are similar to those of the first preferred embodiment.

According to the fourth preferred embodiment of the present invention, the following advantageous effects are achieved.

According to the fourth preferred embodiment of the present invention, the first support 460 includes the fixed portion 460*a* fixed to the transom 11*a*, and the link 460*b* including the front end supported by the fixed portion 460*a* and the rear end that rotatably supports the tilt shaft 40 of the support 4, and the position adjuster 407 includes the rotation restricting shaft 460*d* inserted into the fixed portion 460*a* and the link 460*b* and that maintains the angle of the link 460*b* at the predetermined angle by restricting rotation of the link 460*b* with respect to the fixed portion 460*a*, but is also able to change the predetermined angle. Accordingly, the rotation restricting shaft 460*d* restricts rotation of the link 460*b* with respect to the fixed portion 460*a* by maintaining the angle of the link 460*b* at the predetermined angle, but is also able to change the predetermined angle such that the position of the tilt shaft 40 supported by the rear end of the link 460*b* with respect to the first trim cylinder shaft 51 is changed by the rotation restricting shaft 460*d*. Therefore, a structure that changes (adjusts) the distance between the tilt shaft 40 and the first trim cylinder shaft 51 is achieved by the fixed portion 460*a*, the link 460*b*, and the rotation restricting shaft 460*d*.

The remaining advantageous effects of the fourth preferred embodiment are similar to those of the first preferred embodiment.

Fifth Preferred Embodiment

A fifth preferred embodiment of the present invention is now described with reference to FIGS. 1, 10, and 11. According to the fifth preferred embodiment, the positions of first supports 560 in an upward-downward direction are changed using an upward-downward drive cylinder 570, unlike the first preferred embodiment in which the positions of the first supports 60 in the upward-downward direction are changed using the fasteners 71. In the fifth preferred embodiment, the same structures as those of the first preferred embodiment are denoted by the same reference numerals, and description thereof is omitted.

Figure 10:
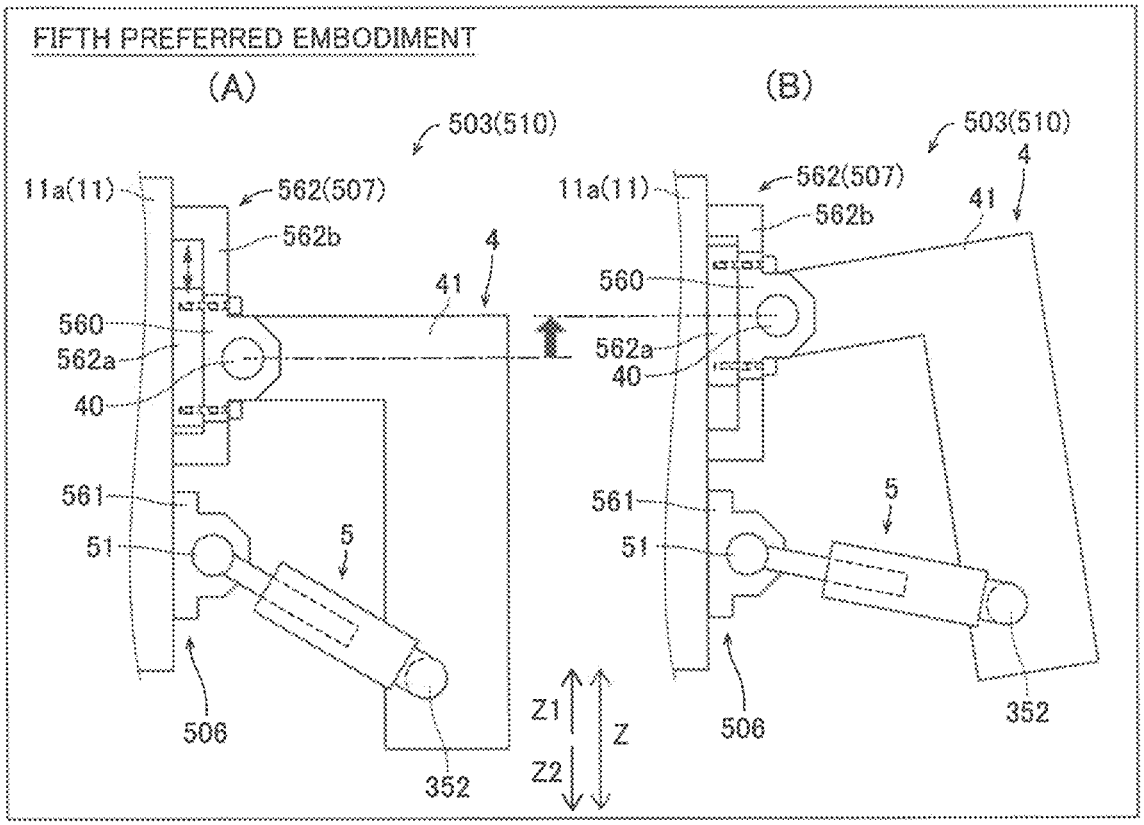
FIG. 10 is a side view showing an outboard motor movement mechanism according to the fifth preferred embodiment of the present invention.

As shown in FIG. 1, an outboard motor 510 according to the fifth preferred embodiment includes an outboard motor main body 2 and an outboard motor movement mechanism 503 (see (A) of FIG. 10).

As shown in (A) of FIG. 10, the outboard motor movement mechanism 503 includes a support 4, a trim cylinder 5 disposed below the support 4, and a mount 506 attached to the outer surface of the transom 11*a*.

The mount 506 includes the first supports 560 that rotatably support a tilt shaft 40, second supports 561 that rotatably support a first trim cylinder shaft 51, and a guide rail 562 that holds the first supports 560 in an upward and downward movable state. The guide rail 562 functions as a position adjuster 507 described below.

The guide rail 562 and the second supports 561 are attached to the transom 11*a*. The guide rail 562 and the second supports 561 may be attached to the transom 11*a* indirectly via a base plate 263 (see FIG. 7) as described in the second preferred embodiment.

Figure 11:
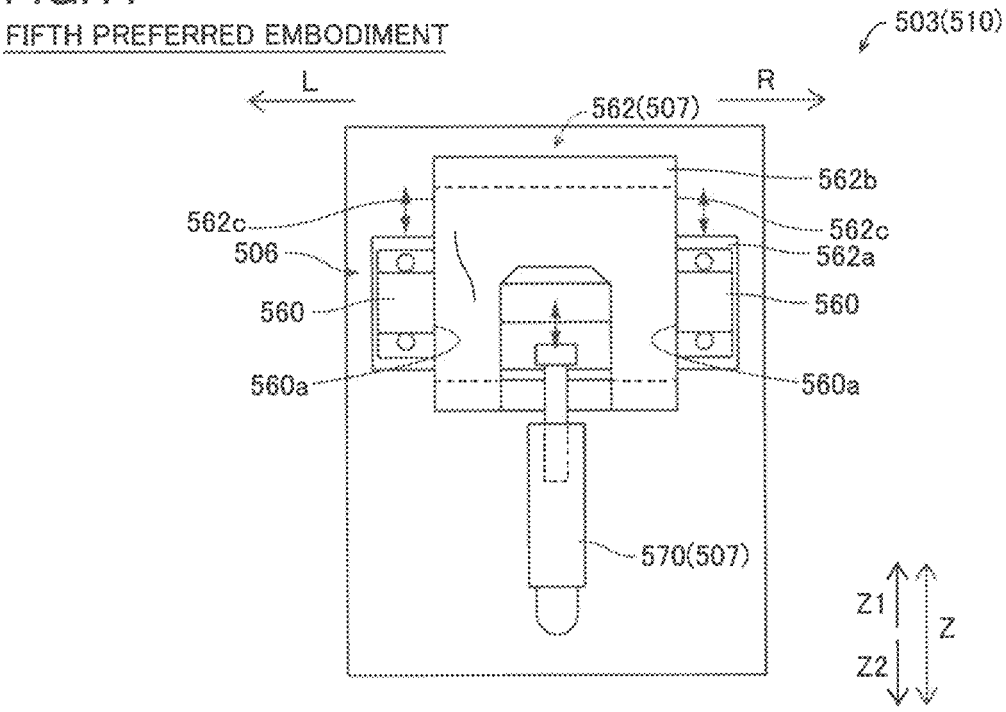
FIG. 11 is a front view showing the outboard motor movement mechanism according to the fifth preferred embodiment of the present invention.

As shown in FIG. 11, the guide rail 562 guides movement of the first supports 560 in the upward-downward direction. The guide rail 562 includes a plate 562*a* and a bracket 562*b*. In FIG. 11, the trim cylinder 5 and a pivoting member 41 are omitted for the convenience of illustration. Furthermore, in FIG. 11, the upward-downward drive cylinder 570 is illustrated larger than its actual size for the purpose of convenience.

The plate 562*a* extends in a right-left direction, and the first supports 560 are attached to opposite ends of the plate 562*a* from the rear side. The bracket 562*b* holds the plate 562*a* from the rear and includes an upper end and a lower end that restrict movement of the plate 562*a* in the upward-downward direction by contact. The bracket 562*b* is preferably C-shaped or substantially C-shaped (hereinafter "C-shaped") and covers the plate 562*a* from the rear (see (A)

of FIG. 10). The plate 562*a* protrudes from opposite ends of the bracket 562*b* in the right-left direction.

The first supports 560 and the plate 562*a* are moved in the upward-downward direction while the first supports 560 are guided in a state in which the inner side surfaces 560*a* of the first supports 560 contact the opposite end surfaces 562*c* of the bracket 562*b* in the right-left direction.

The position adjuster 507 that changes the position of the tilt shaft 40 in the upward-downward direction with respect to the transom 11*a* by changing the positions of the first supports 560 in the upward-downward direction is provided in the mount 506.

The position adjuster 507 includes the guide rail 562 and the upward-downward drive cylinder 570. In (A) and (B) of FIG. 10, the upward-downward drive cylinder 570 is omitted for the convenience of illustration.

The upward-downward drive cylinder 570 extends in the upward-downward direction below the tilt shaft 40, and its upper end is fixed to the plate 562*a*. Therefore, the plate 562*a*, the first supports 560, and the tilt shaft 40 are moved upward (from the state of (A) of FIG. 10 to the state of (B) of FIG. 10) as the upward-downward drive cylinder 570 is expanded. Consequently, a distance between the tilt shaft 40 and the first trim cylinder shaft 51 is increased. That is, the trim and tilt operating ranges of the outboard motor main body 2 are changed to the positive side (both the upper and lower limits of the operating ranges are raised).

On the other hand, the plate 562*a*, the first supports 560, and the tilt shaft 40 are moved downward as the upward-downward drive cylinder 570 is contracted. Consequently, the distance between the tilt shaft 40 and the first trim cylinder shaft 51 is decreased. That is, the trim and tilt operating ranges of the outboard motor main body 2 are changed to the negative side (both the upper and lower limits of the operating ranges are lowered).

A second trim cylinder shaft 352 of the fifth preferred embodiment preferably has the same structure as that of the third preferred embodiment, and thus it is denoted by the same reference numeral, and description thereof is omitted.

The remaining structures of the fifth preferred embodiment are similar to those of the first preferred embodiment.

According to the fifth preferred embodiment of the present invention, the following advantageous effects are achieved.

According to the fifth preferred embodiment of the present invention, the position adjuster 507 includes the guide rail 562 that guides movement of the first supports 560 in the upward-downward direction. Accordingly, the first supports 560 are reliably disposed on the path of the guide rail 562, and thus the guide rail 562 prevents the deviation of the attachment positions of the first supports 560.

According to the fifth preferred embodiment of the present invention, the position adjuster 507 further includes the upward-downward drive cylinder 570 that moves the first supports 560 in the upward-downward direction along the guide rail 562. Accordingly, the first supports 560 are easily moved along the guide rail 562 by the upward-downward drive cylinder 570.

The remaining advantageous effects of the fifth preferred embodiment are similar to those of the first preferred embodiment.

Sixth Preferred Embodiment

A sixth preferred embodiment of the present invention is now described with reference to FIGS. 1 and 12. According to the sixth preferred embodiment, an outboard motor main body 602 is supported by a support 604 and a trim cylinder 5, unlike the first preferred embodiment in which the outboard motor main body 2 is supported only by the support 4. In the sixth preferred embodiment, the same structures as those of the first preferred embodiment are denoted by the same reference numerals, and description thereof is omitted.

Figure 12:
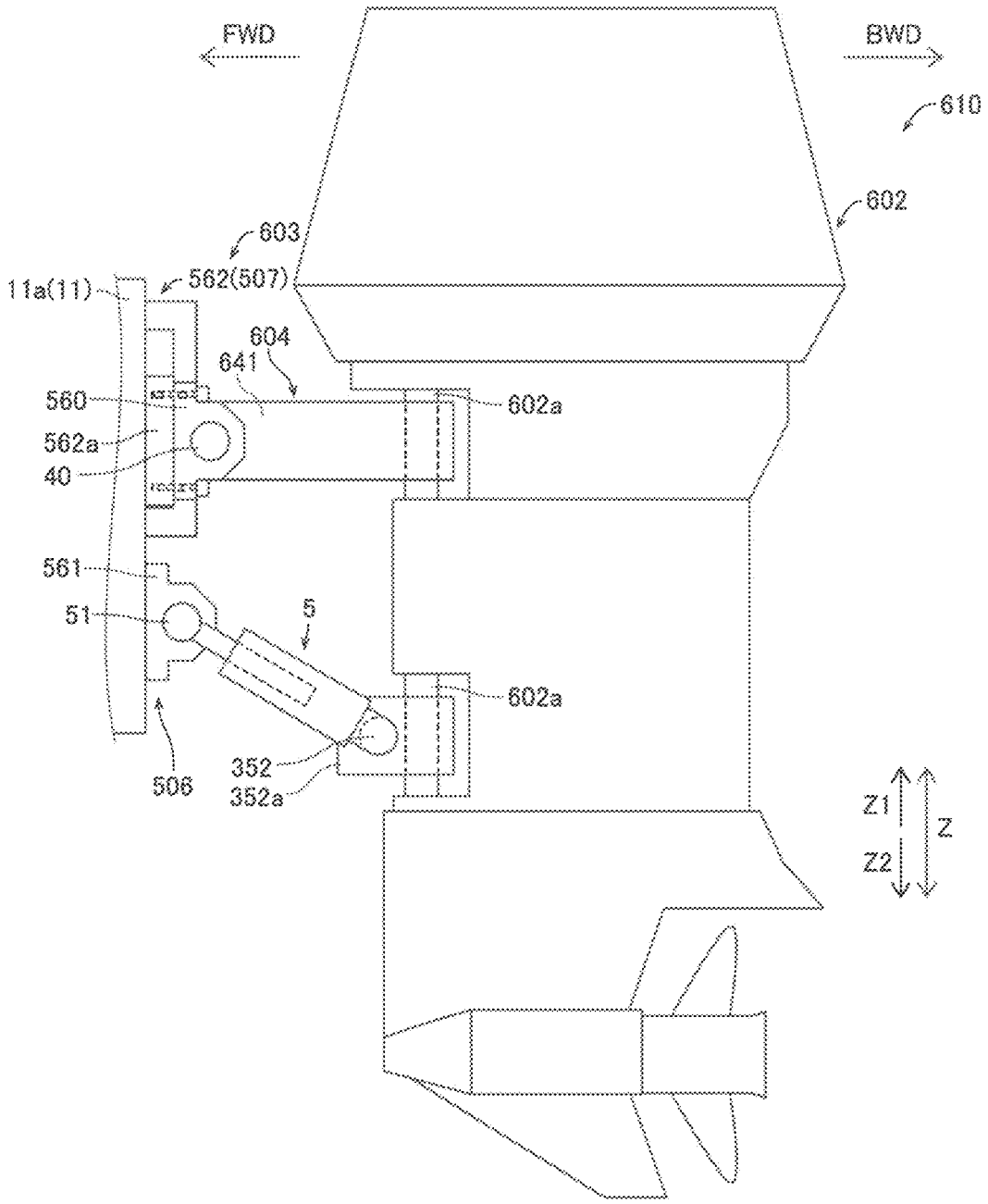
FIG. 12 is a side view showing the outboard motor according to the sixth preferred embodiment of the present invention.

As shown in FIG. 1, an outboard motor 610 according to the sixth preferred embodiment includes an outboard motor main body 602 and an outboard motor movement mechanism 603 (see FIG. 12).

As shown in FIG. 12, the outboard motor main body 602 includes pivot shafts 602*a* integral and unitary with the outboard motor main body 602. A pair of pivot shafts 602*a* are disposed at a predetermined interval in an upward-downward direction. The pivot shafts 602*a* are shafts (steering shafts) that function as the steering center of the outboard motor main body 602.

The outboard motor movement mechanism 603 includes the support 604, the trim cylinder 5 disposed below the support 4, and a mount 506 attached to the outer surface of a transom 11*a*.

The mount 506 preferably has the same structure as that of the fifth preferred embodiment, and thus it is denoted by the same reference numeral, and description thereof is omitted.

The support 604 includes a tilt shaft 40 and a pivoting member 641 provided between the tilt shaft 40 and the pivot shafts 602*a*. The pivoting member 641 linearly extends rearward from the tilt shaft 40. A rear end of the pivoting member 641 supports a pivot shaft 602*a* such that the pivot shaft 602*a* is rotatable about its own axis. The pivoting member 641 supports the upper pivot shaft 602*a*.

A second trim cylinder shaft 352 includes a connector 352*a* that connects to a pivot shaft 602*a* at its rear end. The second trim cylinder shaft 352 supports the pivot shaft 602*a* via the connector 352*a*. Therefore, the second trim cylinder shaft 352 supports the pivot shaft 602*a* such that the pivot shaft 602*a* is rotatable about its own axis and such that the pivot shaft 602*a* is rotatable about the axis of the second trim cylinder shaft 352. The second trim cylinder shaft 352 supports the lower pivot shaft 602*a*.

The second trim cylinder shaft 352 of the sixth preferred embodiment preferably has the same structure as that of the third preferred embodiment, and thus it is denoted by the same reference numeral, and detailed description thereof is omitted.

The remaining structures of the sixth preferred embodiment are similar to those of the first preferred embodiment.

According to the sixth preferred embodiment of the present invention, the following advantageous effects are achieved.

According to the sixth preferred embodiment of the present invention, the trim cylinder 5 includes the second trim cylinder shaft 352 disposed at a rear end of the trim cylinder 5, the outboard motor main body 602 includes the pivot shafts 602*a* integral and unitary with the outboard motor main body 602, and the pivot shafts 602*a* are supported at the rear end of the support 604 and the second trim cylinder shaft 352 so as to be rotatable in a right-left direction. Accordingly, the number of components is reduced as compared with the case in which the pivot shafts 602*a* are separate from the outboard motor main body 602, and thus the device structure is simplified. Furthermore, the outboard motor main body 602 is more securely steered as compared with the case in which the pivot shafts 602*a* are separate from the outboard motor main body 602.

According to the sixth preferred embodiment of the present invention, the trim cylinder 5 and the support 604 respectively support the pivot shafts 602*a*, and the second trim cylinder shaft 352 is located below the first trim cylinder shaft 51 when the trim cylinder 5 is in the most contracted state. Accordingly, as compared with the case in which the second trim cylinder shaft 352 is located above the first trim cylinder shaft 51 when the trim cylinder 5 is in the most contracted state, the trim cylinder 5 supports the pivot shaft 602*a* at a position farther away from the tilt shaft 40 (fulcrum). Thus, the outboard motor main body 602 is trimmed and tilted with less power.

The remaining advantageous effects of the sixth preferred embodiment are similar to those of the first preferred embodiment.

The preferred embodiments of the present invention described above are illustrative in all points and not restrictive. The extent of the present invention is not defined by the above description of the preferred embodiments but by the scope of the claims, and all modifications within the meaning and range equivalent to the scope of the claims are further included.

Figure 13:
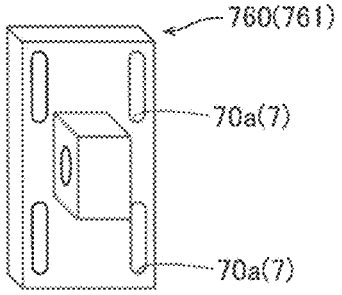
FIG. 13 is a perspective view showing a first support and a second support of an outboard motor movement mechanism according to a first modified example of a preferred embodiment of the present invention.

For example, while the first supports and the second supports preferably include the plurality of holes through which the fasteners are attached in the first preferred embodiment described above, the present invention is not restricted to this. As in a first modified example shown in FIG. 13, first supports 760 and second supports 761 may alternatively include a plurality of holes (long holes) 70*a* that extend in an upward-downward direction and through which fasteners are attached.

Figure 14:
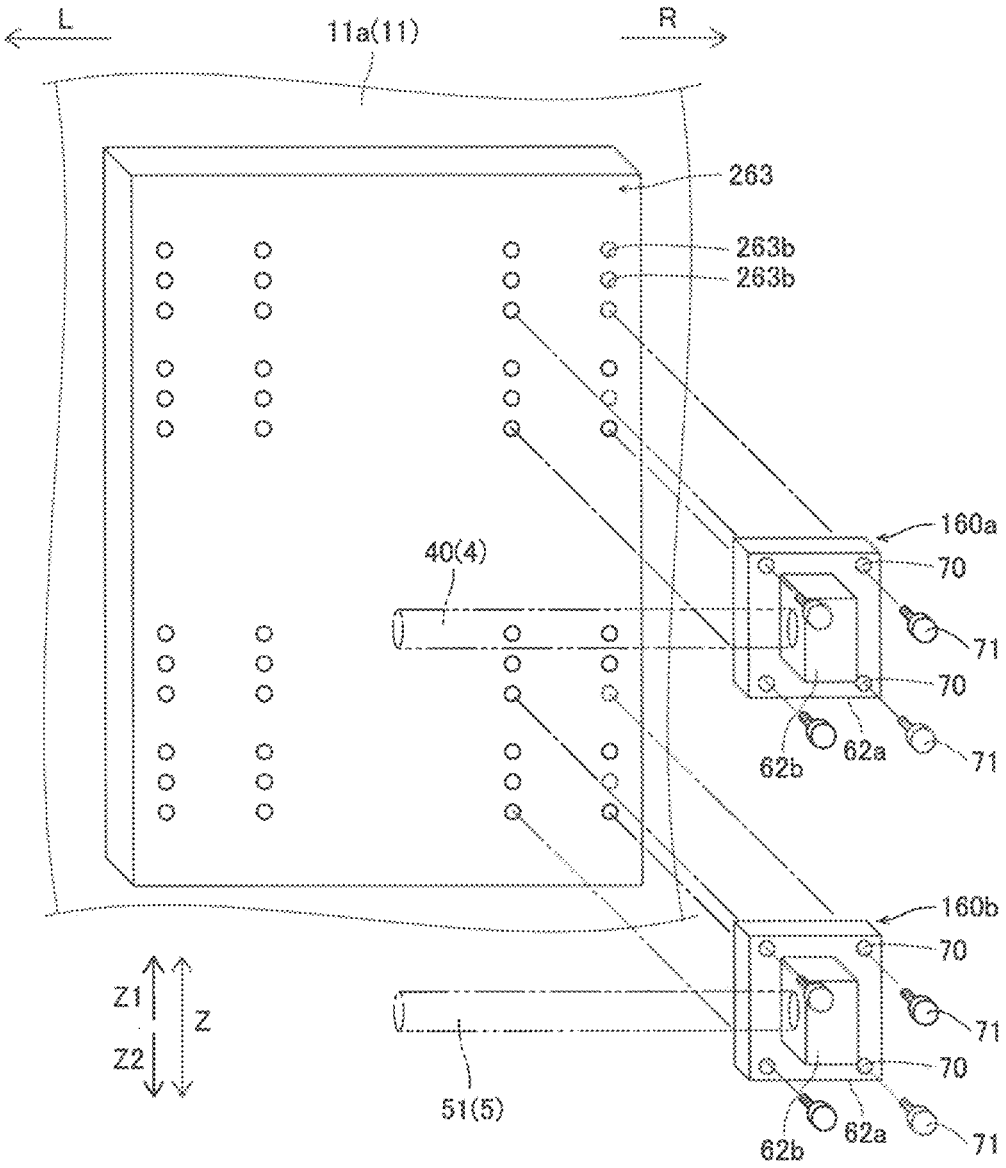
FIG. 14 is a perspective view showing a mount, a trim shaft, and a tilt shaft of an outboard motor movement mechanism according to a second modified example of a preferred embodiment of the present invention.

While the first supports and the second supports preferably include the plurality of holes through which the first supports and the second supports are attached to the base plate by the fasteners in the second preferred embodiment described above, the present invention is not restricted to this. As in a second modified example shown in FIG. 14, a plurality of mounting holes 263*b* aligned in an upward-downward direction and through which first supports 160*a* and second supports 160*b* are attached to a base plate 263 by fasteners 71 may alternatively be provided in the base plate 263.

Figure 15:
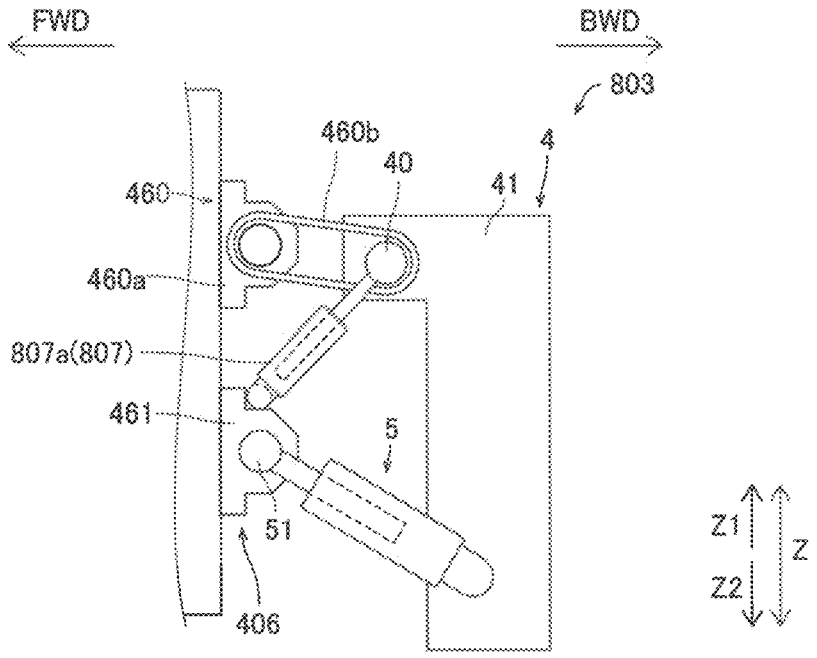
FIG. 15 is a side view showing an outboard motor movement mechanism according to a third modified example of a preferred embodiment of the present invention.

While the rotation restricting shaft that functions as the position adjuster preferably restricts rotation of the link with respect to the fixed portion in the fourth preferred embodiment described above, the present invention is not restricted to this. As in an outboard motor movement mechanism 803 according to a third modified example shown in FIG. 15, a cylinder 807*a* that functions as a position adjuster 807 may alternatively restrict rotation of a link 460*b* with respect to a fixed portion 460*a*, and may alternatively move a tilt shaft 40. In such a case, a first end of the cylinder 807*a* is rotatably supported by a second support 461, and a second end of the cylinder 807*a* supports a tilt shaft 40 disposed at a rear end of the link 460*b*.

Figure 16:
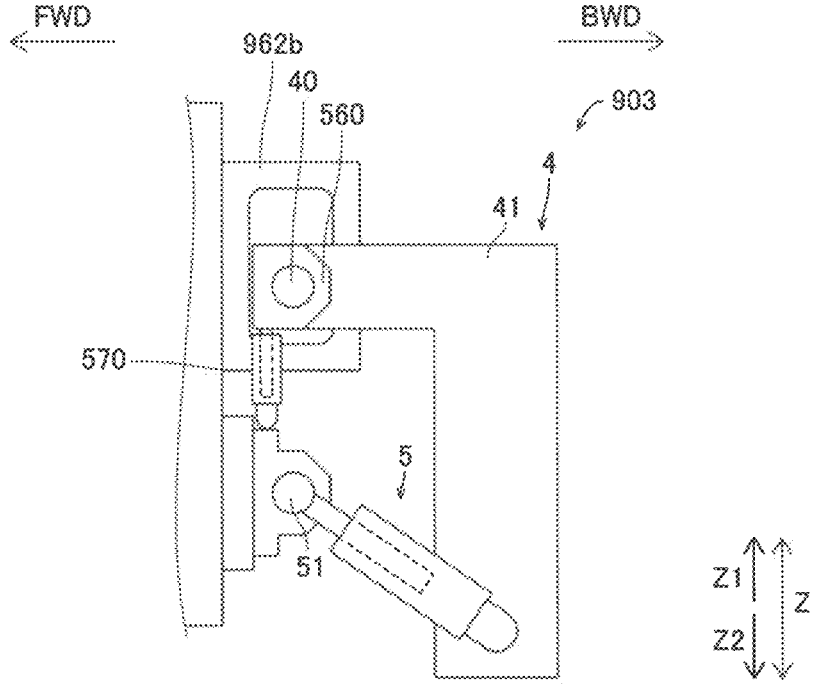
FIG. 16 is a side view showing an outboard motor movement mechanism according to a fourth modified example of a preferred embodiment of the present invention.

While the guide rail (bracket) preferably is C-shaped as viewed in the direction in which the tilt shaft extends in the fifth preferred embodiment described above, the present invention is not restricted to this. As in an outboard motor movement mechanism 903 according to a fourth modified example shown in FIG. 16, a bracket 962*b* that guides movement of a first support 560 and a tilt shaft 40 in an upward-downward direction may alternatively have a rectangular frame shape as viewed in a direction in which the tilt shaft 40 extends.

While a number of the plurality of holes provided in each of the first supports and the second supports is preferably three in each of the first and second preferred embodiments described above, the present invention is not restricted to this. A number of the plurality of holes may alternatively be two or four or more.

While the marine vessel preferably includes one outboard motor in each of the first to sixth preferred embodiments described above, the present invention is not restricted to this. The marine vessel may alternatively include a plurality of outboard motors.

While the outboard motor movement mechanism preferably includes one trim cylinder in each of the first to sixth preferred embodiments described above, the present invention is not restricted to this. The outboard motor movement mechanism may alternatively include a plurality of trim cylinders.

While at least the first support(s) is preferably movable in each of the first to sixth preferred embodiments described above, the present invention is not restricted to this. At least the second support(s) may alternatively be movable.

While the fasteners are preferably bolts in each of the first and second preferred embodiments described above, the present invention is not restricted to this. The fasteners may alternatively be members other than bolts, such as pins attachable to the transom.

While the spacer mount is preferably defined by the annular inner surface of the through-hole of the second support in the third preferred embodiment described above, the present invention is not restricted to this. For example, the spacer mount may alternatively be defined by a recess provided in the second support.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an outboard motor main body;

a support including a tilt shaft and that supports the outboard motor main body;

a trim cylinder including a first trim cylinder shaft disposed below the tilt shaft along an outer surface of a transom of a hull;

a mount attached to the outer surface of the transom and that rotatably supports each of the tilt shaft and the first trim cylinder shaft; and a base plate attached to the transom and on which the mount is installed; wherein a distance between the tilt shaft and the first trim cylinder shaft supported by the mount installed on the base plate is adjustable.

2. The outboard motor according to claim 1, wherein the mount includes a first support that rotatably supports the tilt shaft, and a second support provided separately from the first support and that rotatably supports the first trim cylinder shaft; and the distance between the tilt shaft and the first trim cylinder shaft is adjusted by changing a relative position between the first support and the second support in an upward-downward direction.

3. The outboard motor according to claim 2, further comprising a position adjuster provided in the mount and that changes a position of at least one of the tilt shaft and the first trim cylinder shaft in the upward-downward direction with respect to the transom by changing a position of at least one of the first support and the second support in the upward-downward direction.

4. The outboard motor according to claim 3, wherein the first support and the second support are independently repositionable relative to each other in the upward-downward direction.

5. The outboard motor according to claim 4, wherein the position adjuster includes:

a plurality of mounting holes aligned in the upward-downward direction in the base plate; and a fastener inserted into one of the plurality of mounting holes and that fixes at least one of the first support and the second support to the base plate so as to maintain the position of at least one of the tilt shaft and the first trim cylinder shaft in the upward-downward direction with respect to the transom.

6. An outboard motor movement mechanism comprising:

a support including a tilt shaft and that supports an outboard motor main body;

a trim cylinder including a trim cylinder shaft disposed below the tilt shaft along an outer surface of a transom of a hull;

a mount attached to the outer surface of the transom and that rotatably supports each of the tilt shaft and the first trim cylinder shaft; and a base plate attached to the transom and on which the mount is installed; wherein a distance between the tilt shaft and the trim cylinder shaft supported by the mount installed on the base plate is adjustable.

7. The outboard motor movement mechanism according to claim 6, wherein the mount includes a first support that rotatably supports the tilt shaft, and a second support provided separately from the first support and that rotatably supports the trim cylinder shaft; and the distance between the tilt shaft and the trim cylinder shaft is adjusted by changing a relative position between the first support and the second support in an upward-downward direction.

8. The outboard motor movement mechanism according to claim 7, further comprising a position adjuster provided in the mount and that changes a position of at least one of the tilt shaft and the trim cylinder shaft in the upward-downward direction with respect to the transom by changing a position of at least one of the first support and the second support in the upward-downward direction.

* * * * *